US005713699A

United States Patent [19]

Obermeyer et al.

[11] Patent Number: 5,713,699

[45] Date of Patent: Feb. 3, 1998

[54] SPILLWAY CREST GATE SYSTEM AND INFLATABLE BLADDER THEREFOR

[76] Inventors: Henry K. Obermeyer, 303 W. County Rd. 74, Wellington, Colo. 80549; Robert D. Eckman, 2400 Hampshire Square, Ft. Collins, Colo. 80526

[21] Appl. No.: 490,643

[22] Filed: Jun. 15, 1995

Related U.S. Application Data

[63] Continuation-in-part of Ser. No. 43,902, Apr. 7, 1993, abandoned, which is a continuation-in-part of Ser. No. 844,825, Mar. 2, 1992.

[51] Int. Cl.[6] ..... E02B 7/04

[52] U.S. Cl. ..... 405/115; 405/91

[58] Field of Search ..... 405/115, 91, 114; 156/401, 307.1; 428/113; 474/261, 262, 264

[56] References Cited

U.S. PATENT DOCUMENTS 4,780,024 10/1988 Obermeyer et al. ..... 405/115

FOREIGN PATENT DOCUMENTS 0295908 11/1989 Japan ..... 405/115

WO00649 1/1990 WIPO ..... 405/115

*Primary Examiner*—Dennis L. Taylor

*Attorney, Agent, or Firm*—Dean P. Edmundson

[57] ABSTRACT

Several gate panels are pivotably mounted on top of a dam spillway which are raised against the force of water by inflatable bladders. The bladders are integrally vulcanized envelopes. A unique method of inflatable bladder reinforcement is disclosed. Improvements in connecting the gate panels to the air bladder, to the restraining straps, to each other, and to the dam spillway are disclosed. Improvements in gate panel construction are disclosed.

18 Claims, 36 Drawing Sheets

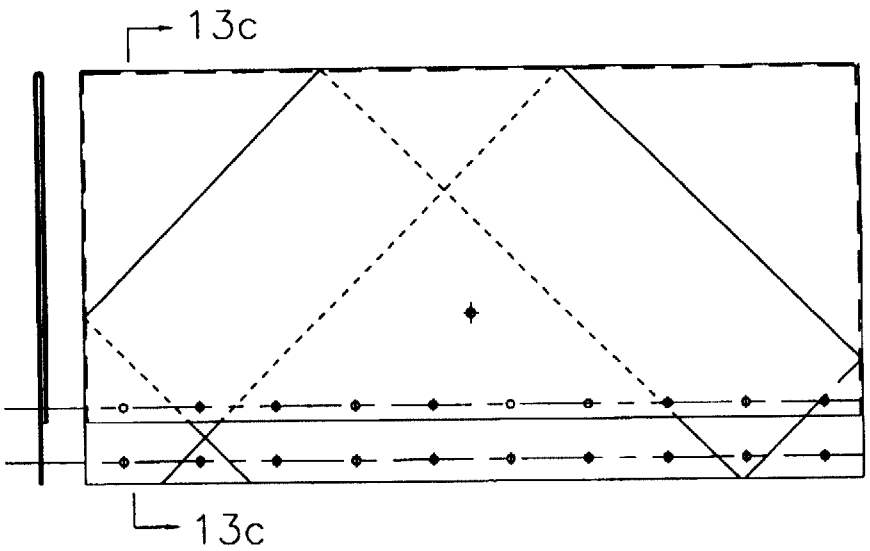
Fig. 13a
Fig. 13c
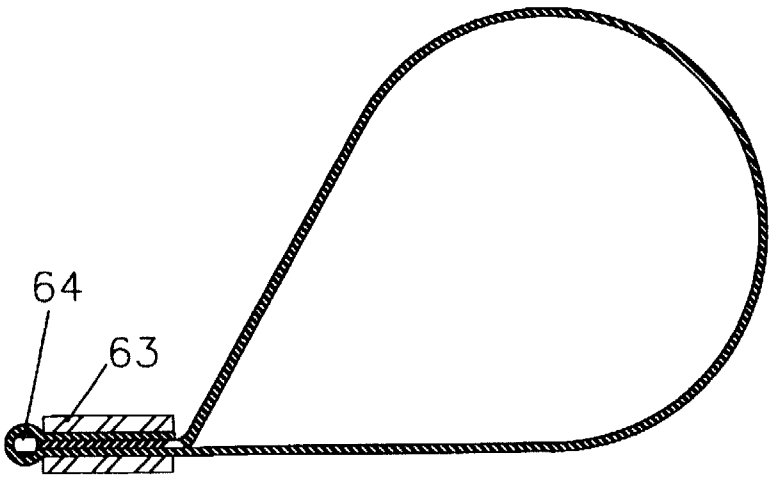
Fig. 13b

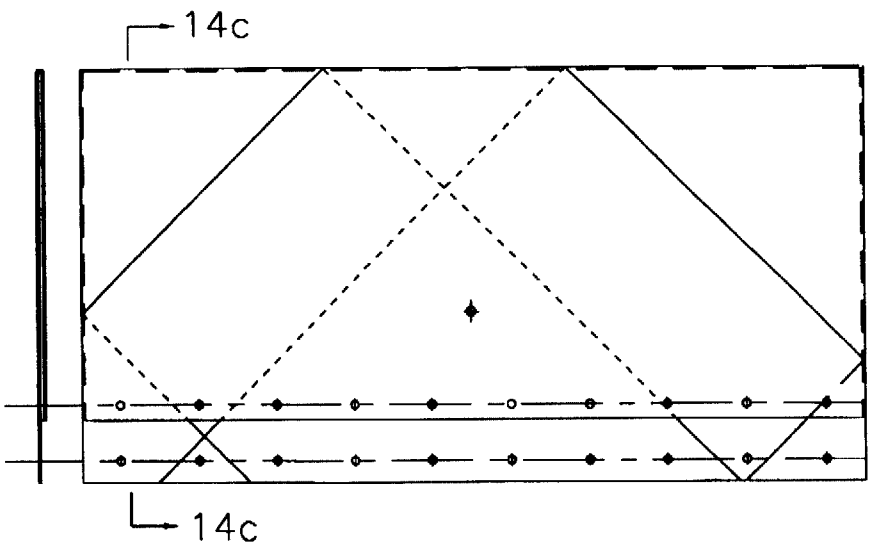
Fig. 14a
Fig. 14c
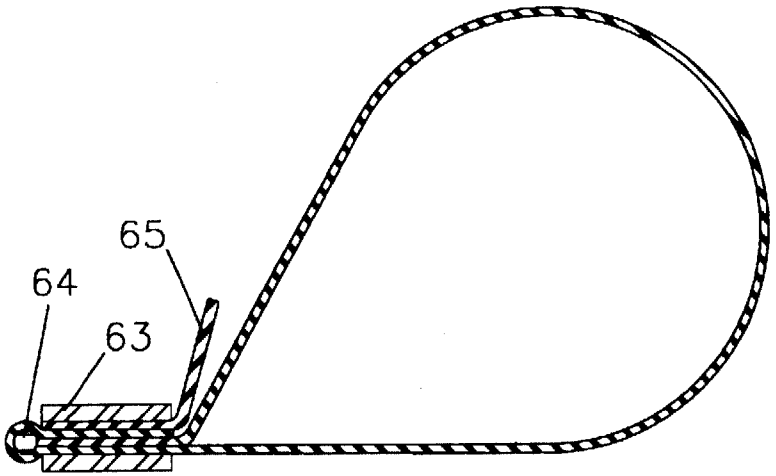
Fig. 14b

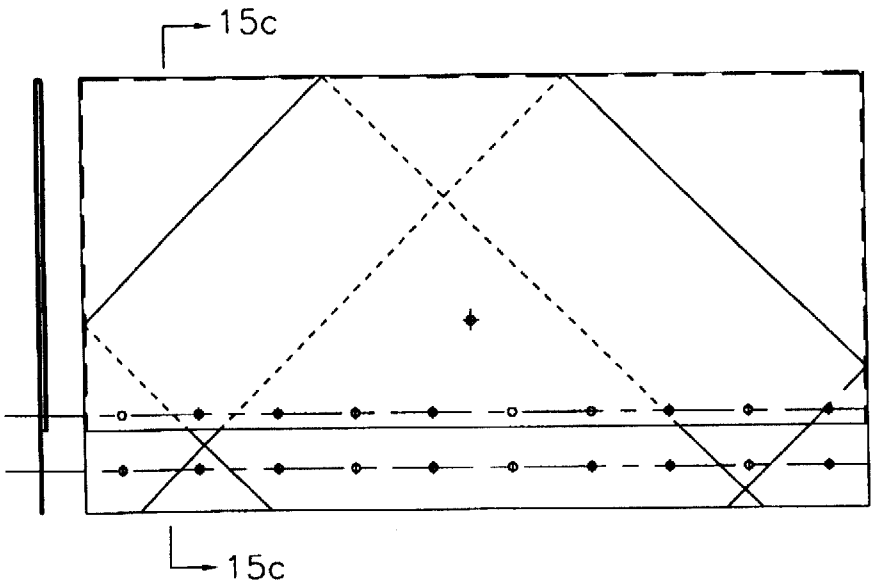
Fig. 15a
Fig. 15b
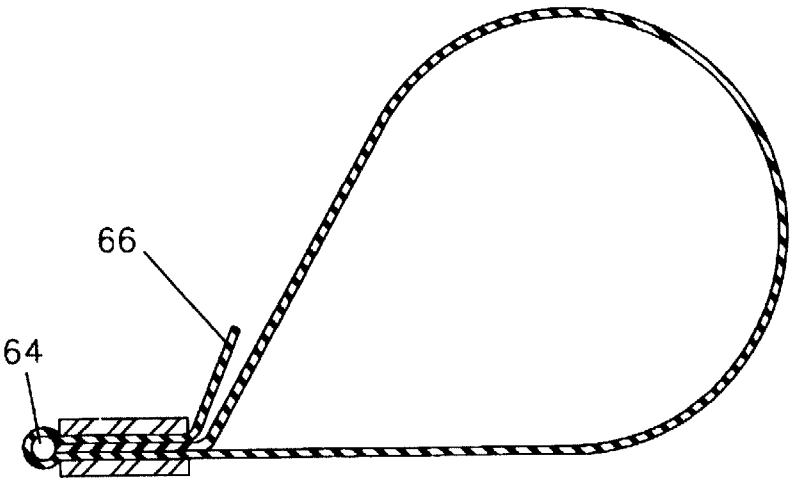
Fig. 15c

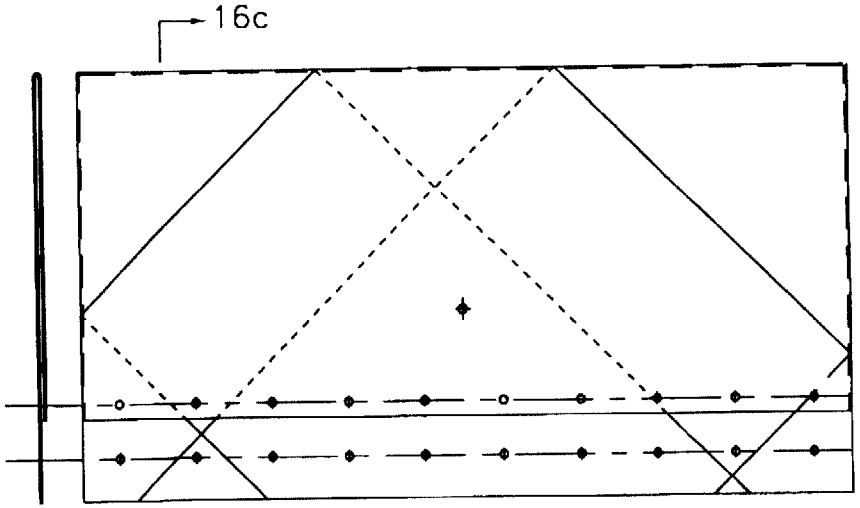
Fig. 16a
Fig. 16b
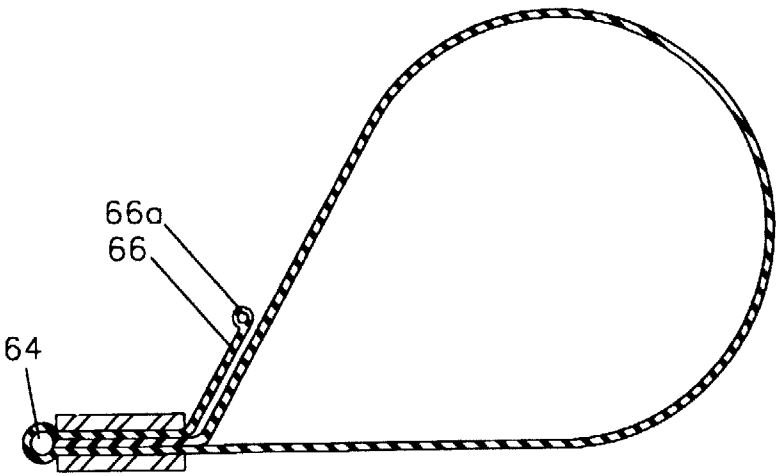
Fig. 16c

SPILLWAY CREST GATE SYSTEM AND INFLATABLE BLADDER THEREFOR

CROSS-REFERENCE TO RELATED APPLICATION

This is a continuation-in-part of our application Ser. No. 08/043,902, filed Apr. 7, 1993, abandoned which is a continuation-in-part of the copending application Ser. No. 07/844,825, filed in the name of Henry Obermeyer, on Mar. 2, 1992.

FIELD OF THE INVENTION

This invention relates generally to crest gates for dam spillways and deals more particularly with a rigid gate pivotably provided at the top of the fixed spillway structure, which rigid gate is movable to a raised position by means of an inflatable bladder.

The provision of movable gates at the crest of a conventional dam spillway generally takes the form of an operating gate that may be either a rigid gate structure hydraulically raised or lowered to vary the height or head of the water, or in accordance with more recent technology, such a gate may take the form of an inflatable tube anchored at the upstream edge to a foundation so the tube itself when inflated raises the gate panels and when deflated lowers the gate panels.

The present invention provides a system of this general type which can withstand greater loads and can be constructed in larger sizes than those shown and described in copending application Ser. No. 844,825 or in prior art.

DESCRIPTION OF RELATED ART

U.S. Pat. No. 4,780,024 discloses a crest gate for a dam spillway that consists of one or more pivotably mounted panels which are actuated by elongated tubular bladders. By supplying air pressure to the tubular bladders the gate panels pivot around their lower edge creating a barrier behind which water is stored. By increasing or decreasing the air pressure in the tubular bladders this barrier can then be raised or lowered to maintain a desired upstream pool elevation.

U.S. Pat. No. 5,092,707 discloses a system for operating one or more crest gates arranged longitudinally on a dam spillway. The methods in which crest gate air bladders are constructed and how crest gate systems are attached to the spillway as well as how the bladders are attached to the crest gate panels themselves is disclosed. Means are also provided so that the control system can be located remotely from the dam spillway itself and that compressed air can be delivered to the air bladder by means of air lines extending along a trench provided in the dam spillway.

Inflatable bladders constructed using prior technology are constructed in such a way that cord ends terminate in inflatable portions of the bladder which are highly stressed. These terminated cords create regions of high stress in the elastomeric portion of the air bladder which limit burst pressure as well as safe operating pressure. Previous technology also depends on a secondary process to close the air bladder ends to complete an inflatable envelope.

SUMMARY OF INVENTION

The purpose of this patent is to disclose improvements to the inflatable bladders, gate panels, and restraining mechanisms associated with crest gates or inflatable dams and to provide an inflatable bladder that can be used in other applications where an inflatable actuator may be used.

Crest gate systems in their presently preferred form use an inflatable air bladder anchored to a dam spillway by anchor bolt and clamp bar to actuate a steel gate panel. This steel gate panel can then be raised or lowered to adjust the elevation of the upstream pool.

Crest gate systems in their presently preferred form use a seamless air bladder to actuate the steel gate panels. The bladder itself comprises several directionally reinforced elastomeric sheets layered one above another. The bladder is further configured in such a way as to ensure that none of the directional reinforcing cords terminate in inflated portions of the bladder which are highly stressed. By using the seamless technology of the present invention these end flaps are eliminated and thus a stronger bladder produced. These stronger bladders can then be used in higher head crest gate applications or where higher bladder pressures may be utilized, and do not provide highly stressed zones in the elastomer which would be subject to ozone cracking.

The preferred method by which these inflatable bladders are manufactured is by laying up uncured directionally reinforced elastomeric sheet such as skimmed warp only tire cord type fabric around a mandrel in the shape of the deflated bladder. Preferred reinforcing cords include nylon, polyester, and aramid fibers. Preferred elastomeric material includes EPDM, Butyl, Chloroprene, SBR, and natural rubber. These elastomeric materials may be blended and used in layers in order to utilize the advantages of each type of elastomer. For example, an innerliner of bromobutyl might be used in conjunction with an SBR/natural rubber blend for high strength and adhesion in association with the reinforcing cords with an outer layer containing sufficient EPDM or other high saturation polymer to obtain good ozone cracking resistance. The sheet is wrapped around the mandrel in such a way as to create an envelope with three closed edges and one open edge from which the mandrel is removed after the bladder has been cured. A mandrel with rounded edges is used in order to limit the tensile deformation of the innerliner during inflation and to more nearly balance the tensile loads carried by the successive layers of reinforcement. After the mandrel has been wrapped, the entire assembly is placed into a vacuum bag which is then evacuated. The assembly is then placed in an autoclave where it is cured using heat and pressure. Alternatively, a heated press may be used, in which case the application of a vacuum is optional. This process creates an integral elastomeric matrix in which the reinforcing cords are embedded similar in composition to an automotive tire. The mandrel is then removed from inside the cured envelope portion of the bladder and the open end is sealed in a secondary vulcanization step.

The invention in its presently preferred form also incorporates an incompressible insert along the upstream longitudinal edge of the inflatable air bladder and along the downstream edge of the hinge retainer. The insert along the upstream longitudinal edge of the inflatable bladder is incorporated during the secondary vulcanization process and provides a mechanism that resists the force that tends to pull the air bladder from under its clamp during use. The insert used in the hinge flap is introduced before the bladder envelope is cured and is put in place while the envelope is on the mandrel with one or more layers of bladder reinforcing wrapped around it. This insert creates an enlarged bead in the bladder hinge that resists the forces that tend to pull the steel gate panels away from the inflatable bladder during use. In this manner the final assembly, when inflated and under load, is comprised of three pressurized bladders or envelopes, the largest containing air and the smaller two containing said inserts.

The envelope portion of the inflatable bladder can also be sealed using a process that does not involve a secondary vulcanization process. In using this method the incompressible insert that comprises the upstream enlarged bead is incorporated into the bladder envelope while the bladder is initially being laid up on the mandrel. After the envelope is cured the mandrel is taken out and the bladder envelope is sealed using a clamp bar and anchor bolt. By manufacturing the inflatable air bladder in this manner the upstream enlarged bead and the hinge flap bead are still incorporated in the inflatable bladder. This method allows for the inflatable bladder to be disassembled and repaired internally if damaged. Repairs internal to the air bladder are not a viable option if the inflatable bladders are constructed using a secondary vulcanization process to seal the envelope portion of the inflatable bladder.

For straight dam spillways the inflatable bladder in its presently preferred form is basically rectangular in shape when deflated. The inflatable bladder includes an upstream marginal edge, a downstream marginal edge parallel to said upstream edge, a left edge perpendicular to said upstream edge, a right edge perpendicular to said upstream edge, a top face, and a bottom face.

For curved dam spillways the inflatable bladder can be constructed using an upstream marginal edge, a downstream marginal edge parallel to said upstream edge, a left marginal edge that bisects said upstream edge at 45 degrees, and a right marginal edge that bisects said upstream edge at −45 degrees, a top face, and a bottom face. This type of inflatable bladder allows the crest gate system to be used on curved spillways that would not ordinarily be conducive to crest gate installation using previous technology.

For dams that have both straight and curved sections of spillway or for dams that may have jogs or angled portions of spillway the rectangular and trapezoidal bladders can be used in conjunction with each other. Also in cases where it may be impractical to use both a rectangular and trapezoidal bladder an elastomeric web can be clamped to the spillway and to each adjacent gate panel to fill the void between adjacent air bladders and gate panels.

Another aspect of the present invention is the use of enlarged beads on each end of the restraining strap. The invention in its presently preferred state uses a restraining strap that is fastened to the dam spillway downstream of the inflatable bladder and to the bottom face of the steel gate panel. The restraining strap limits the motion of the steel gate panel and will not allow the crest gate to flip over in the upstream direction during low water conditions. During these low water conditions the forces on the reinforcing strap can be quite high. Using previous technology this restraining strap consisted of a strip of reinforced elastomeric sheet that was fastened to the dam spillway and the steel gate by serrated restraining clamps. However even with these serrated restraining clamps the reinforcing strap tended to slide out and thus cause the crest gate system to slip out of alignment. In accordance with the present invention an incompressible insert is placed within each end of the restraining strap. This insert then forms an enlarged bead on each end of the restraining strap that works much like the bead in the inflatable bladders hinge flap. The reinforcing fibers are wrapped around said inserts at each end of the restraining strap. This enlarged bead ensures that the strap will not slip out from underneath the restraining clamps Crest gates using previous technology also tend to leak water between adjacent air bladders. The present invention uses a thin elastomeric membrane that fits between the inflatable air bladder and the dam spillway and is then wrapped around the bladders upstream bead and then clamped against the web retainers. This effectively stops this water leakage and provides a much more leak tight crest gate system.

The invention in its previously preferred state uses a gate panel comprising a steel plate with optional reinforcing ribs that are generally used in higher head situations. The steel gate panels are basically rectangular in shape with a pivotable upstream edge, a downstream edge, a left edge, a right edge, a top face, and a bottom face. The panels may be shaped to conform to the spillway and/or maximize discharge when in the lowered position. The ribs then run parallel to the left and right edges and provide strength in the upstream downstream direction. For smaller scale systems no reinforcement is needed in the direction parallel to the upstream edge of the steel gate panel because the inflatable bladder provides a continuous support along the bottom face. For larger scale systems where the plate thickness may be smaller in relation to the steel gate panels a means of increasing torsional rigidity in the direction parallel to the downstream edge along the said edge is required. To achieve this, the invention in its presently preferred form uses an enclosed chamber along or near the gate panels downstream edge to torsionally stiffen the steel panel in the direction parallel to the gate panel pivot axis. This resulting torque tube can be a continuous chamber along the bottom, or top of the gate panel or the spaces between ribs along the top of the gate panel can be filled in using steel plate to create the torque tube. The advantage of this invention is that, unlike torsionally rigid gates built using prior techniques the steel gate panels can be configured to conform to the shape of the top of the dam spillway when in the lowered position. The upstream portion of the gate panel can be made very thin in order to not raise the spillway elevation. With the torsionally rigid portion of the gate panel located downstream of the top of the spillway, spillway capacity is maintained during high flow conditions with the crest gate system is in the lowered position.

Another aspect of the invention is the addition of round, preferably stainless steel, bar to the pivot edge of the gate panel. Said bar serves to reduce the compressive stresses imparted to the elastomeric materials of the air bladder and hinge flap in contact with the pivot edge of the gate panel. Said bar also reduces the imbalance of tensile stresses between the reinforcing cord layers of the air bladder and hinge flap. Said bar also eliminates the expensive operation of machining a round edge on the gate panel and if made from stainless steel or other similar corrosion resistant material, provides a long life smooth surface bearing on the elastomeric materials. Said bar also desirably stiffens the gate panel in the highly stressed zone between reinforcing ribs at the pivot edge of the gate panel.

Another aspect of the invention is the addition of a raised protrusion along the length of the top surface of the hinge flap immediately downstream of the clamp bar. Said protrusion occludes sand and gravel from the space between the downstream face of the clamp bar and the upper surface of the hinge flap. Said protrusion prevents the upper surface of the hinge flap from being squeezed against trapped sand and gravel as the gate panel pivots from the lowered to the raised positions.

Another aspect of the invention is the addition of pickets to the gate panels of the crest gate system. These pickets then allow water flow in the downstream direction while preventing any fish migration in the upstream or downstream directions. Recent concerns regarding the populations of the Salmon species in the Northwestern United States has dictated the use of barriers. This so called fish barrier allows migrating salmon to be diverted to fish traps, fish ladders, etc. The fish can then, for example, be taken to fish hatcheries where they can spawn in a less hostile environment thereby allowing a better survival ratio. Previous technology relied on shear man power and the use of seasonally installed screens to achieve a fish barrier. Using this new technology a safer and more effective fish barrier is created.

The final aspect of the invention is the described seamless inflatable bladder which may be used for such purposes as lifting, shock absorption, buoyancy, or fluid storage. The benefits of such an inflatable bladder are that the said inflatable bladder has no discontinuities of reinforcement within the stressed membrane of said bladder and that by using this new technology the bladders are much stronger and provide a safer actuating mechanism that can lift greater loads than has been previously permitted.

Other advantages of the apparatus and methods of this invention will be apparent from the following detailed description and the accompanying drawings.

BRIEF DESCRIPTION OF THE DRAWINGS

FIG. 13*a* illustrates a top view of inflatable bladder with upstream bead.

FIG. 13*b* shows the inflated bladder of FIG. 13*a* in conjunction with a bead along one edge of two clamping plates.

FIG. 13*c* illustrates the bladder of FIG. 13*a* in section taken along line 13*c*—13*c* in FIG. 13*a*.

FIG. 14*a* shows a bladder without an integral hinge flap before secondary vulcanization of the clamped seam.

FIG. 14*b* is a section taken through FIG. 14*a*.

FIG. 14*c* shows the inflated bladder of FIG. 13*a* with non-integral hinge flap.

FIG. 15*a* shows a bladder with an integral hinge flap before secondary vulcanization of the clamped seam.

FIG. 15*b* shows a section taken through FIG. 15*a*.

FIG. 15*c* shows the inflated bladder of FIGS. 15*a* and 15*b*.

FIG. 16*a* illustrates the seamless inflatable bladder with integral hinge flap and enlarged bead.

FIG. 16*b* illustrates the bladder of FIG. 16*a* taken along section line 16*c*—16*c*.

FIG. 16*c* shows the inflated bladder of FIG. 16*a* in the inflated position.

DETAILED DESCRIPTION OF THE PREFERRED EMBODIMENTS

Figure 1:
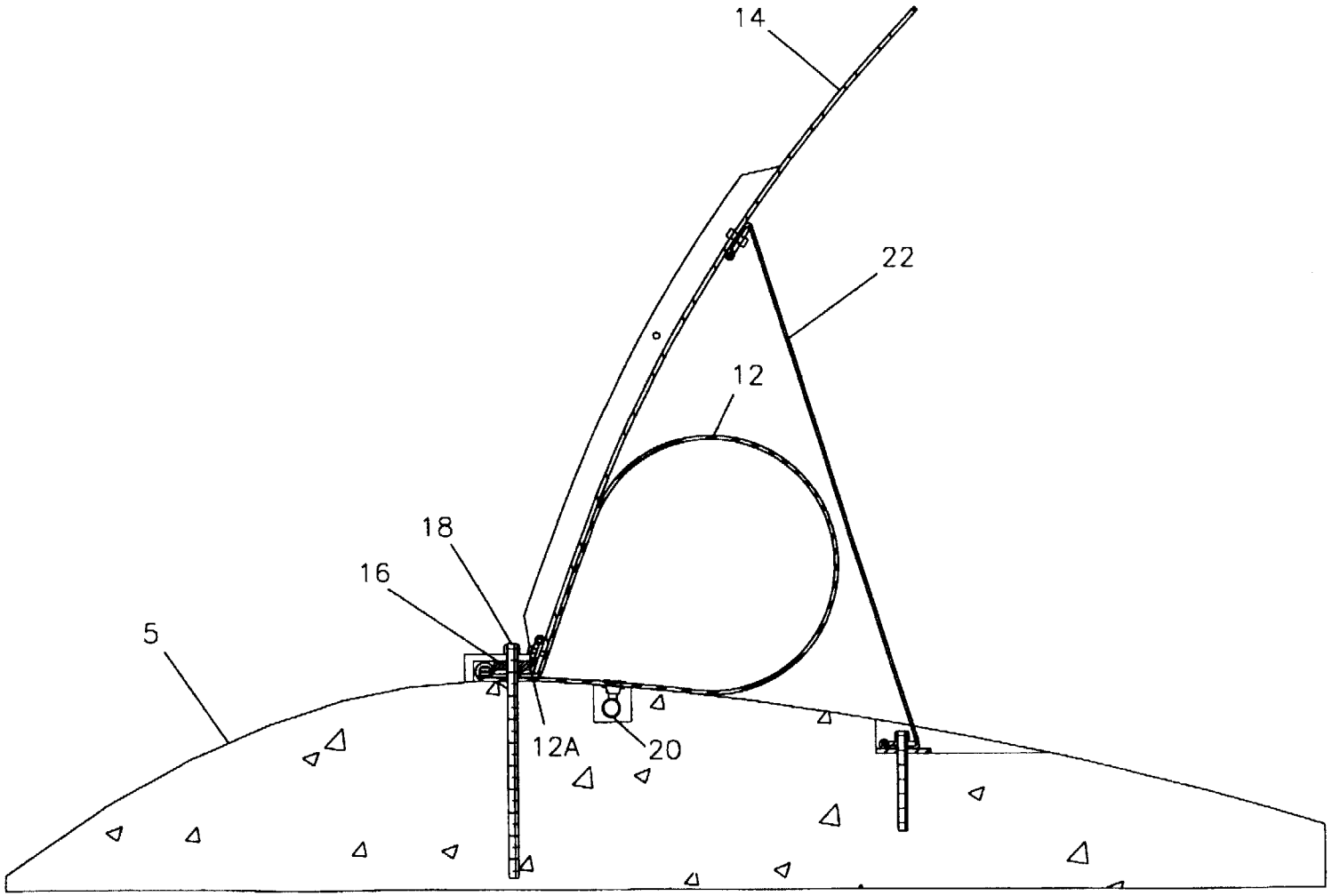
FIG. 1 is a overall vertical cross section view of an improved crest gate system of the invention.

Turning to the drawings in greater detail a crest gate system as shown in FIG. 1 generally includes inflatable bladders 12 provided on the downstream side of one or more pivotal steel panels 14. These bladders are connected to the steel gate panels by means of a hinge 12*a* that is integral to the inflatable bladder. The inflatable bladder and in turn the steel gate panels are then fastened to the spillway of a dam by means of a clamp bar 16 and anchor bolts 18. The inflatable bladder is generally inflated from a source of air pressure through a valve or inlet 20 so as to maintain a desired water level behind the dam. The present invention provides improvements in the inflatable bladder, inflatable bladder hinge mechanism, the means of restraining said crest gate system, the means by which the steel gate panel is reinforced, the use of a crest gate system as a barrier to fish, and the methods by which the gate system is sealed to prevent water leakage.

Referring again to FIG. 1 a typical crest gate application is shown with the crest gate system clamped to the spillway by anchor bolts. The stresses developed in a system of this type are proportional to the damming height if the geometric dimensions, (e.g. plate thickness) are increased in direct proportion to damming height. With larger scale crest gate systems, which dam more water, the inflatable bladder needs to be much stronger than inflatable bladders constructed using prior technology. The invention in its presently preferred state then uses a seamless inflatable bladder which is much stronger then those built using prior know how. Preferably there are one or more restraining straps secured between the upper portion of the gate panel and the spillway on the downstream side.

Figure 2B:
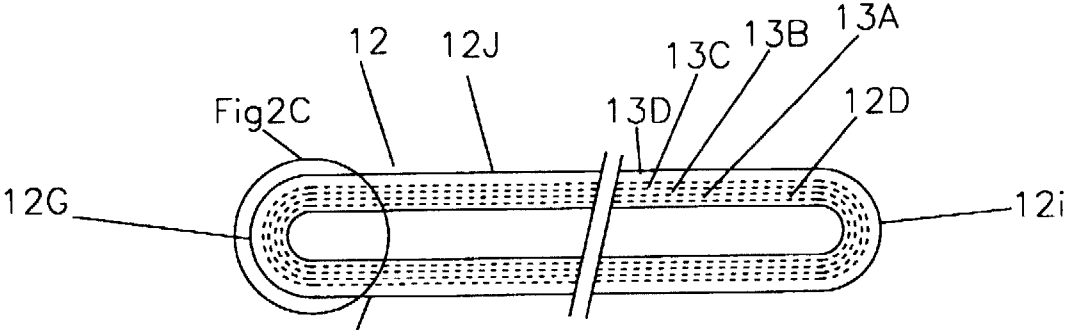
FIG. 2*b* is a sectional view of the inflatable bladder taken along line 2B—2B in FIG. 2*a*.
Figure 2C:
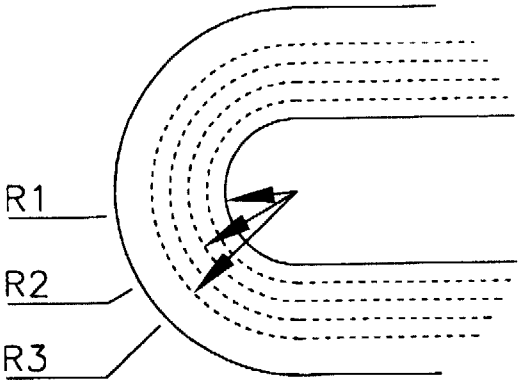
FIG. 2*c* is an enlarged view of the closed bladder edges as they appear in FIG. 2*a* and FIG. 2*b* showing dimensions of the inside radii at said edges.
Figure 2A:
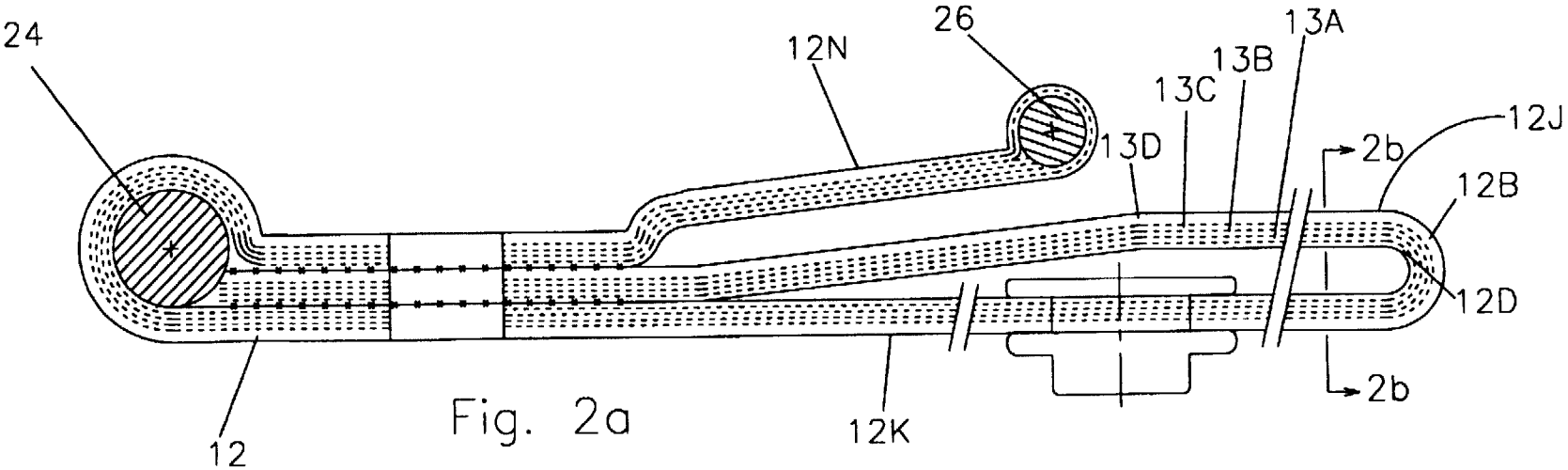
FIG. 2*a* is a sectional view of the inflatable bladder and the hinge flap configuration of this invention.
Figure 2D:
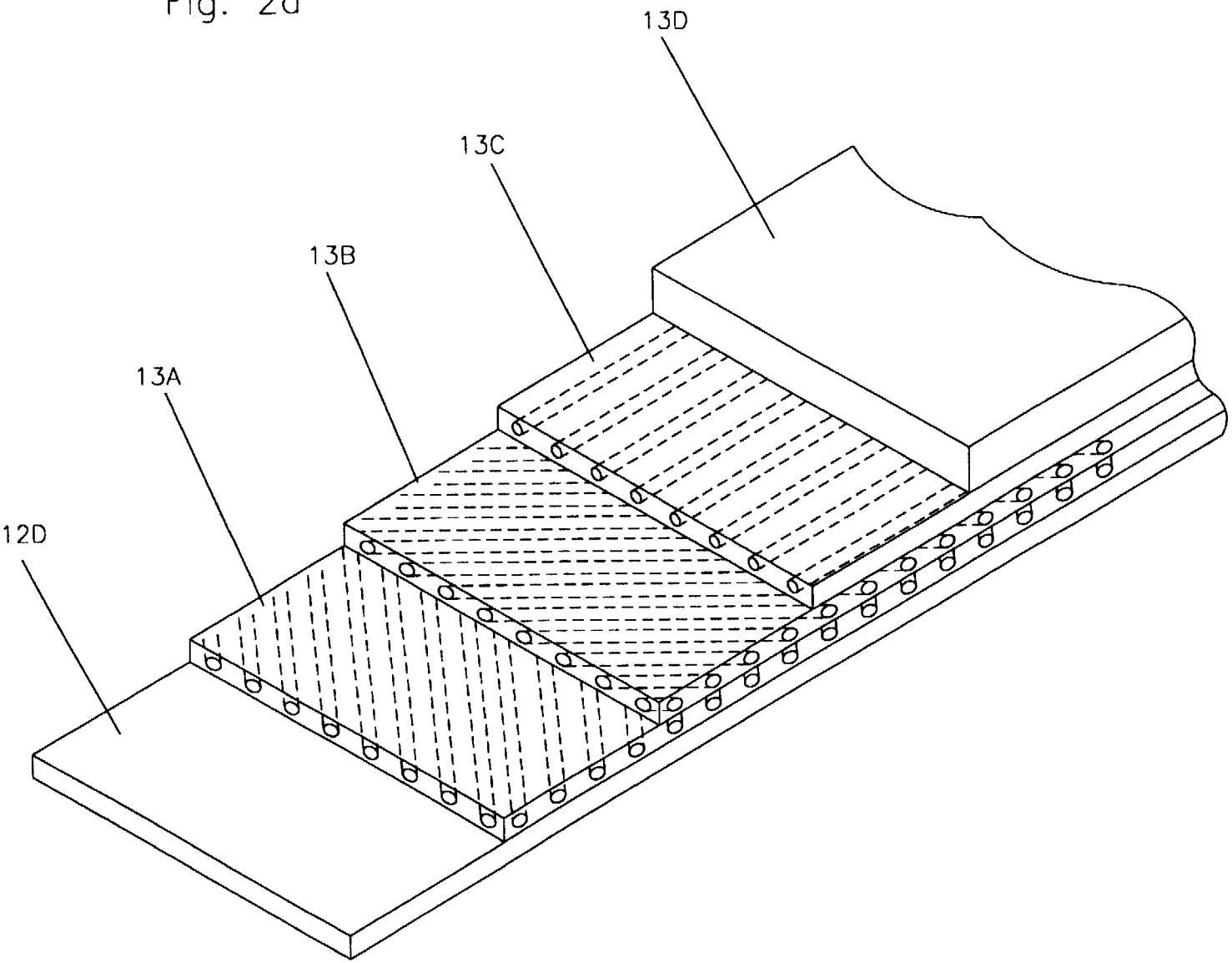
FIG. 2*d* is a cut away view of a piece of the inflatable bladder illustrating the relative orientation of the various layers.
Figure 3:
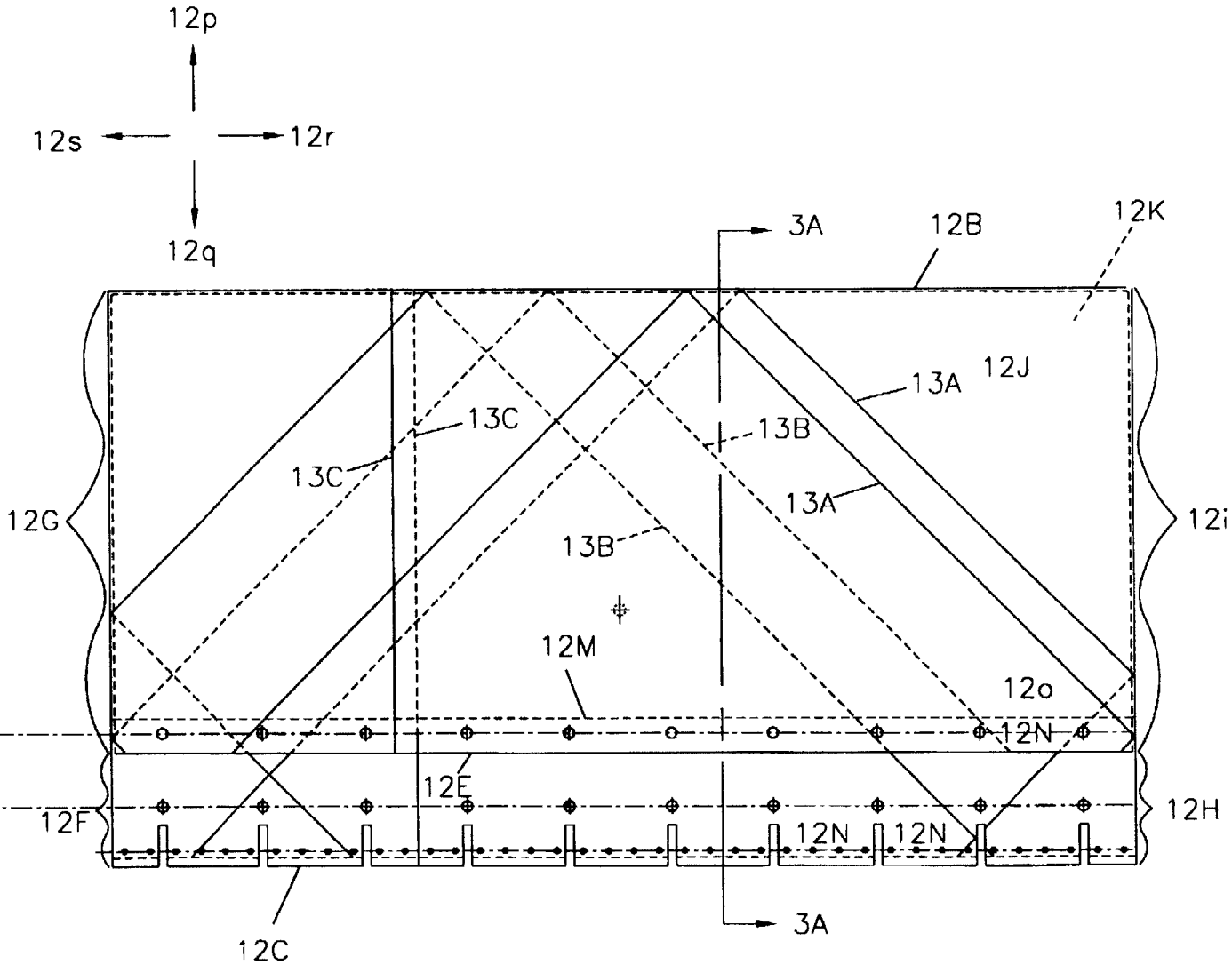
FIG. 3 is a top view illustrating the orientation of reinforcement layers in the inflatable bladder of FIG. 2*a*.

Referring to FIGS. 2*a* and 2*b* and FIG. 3 the inflatable bladder 12 in its presently preferred state is shown. The inflatable bladder is built up from uncured sheets or layers of elastomeric material such as ethylene-propylene diene monomer (EPDM), Butyl, and styrene-butadiene rubber (SBR). These uncured elastomeric materials are also reinforced with unidirectional cords which can comprise of such materials as nylon, polyester or aramid fibers. After the air bladder is wrapped up it is then cured using a source of pressure and heat such as a press or an autoclave.

The directions of upstream, downstream, left and right are indicated in FIG. 3 by 12*q*, 12*p*, 12*s*, and 12*r* respectively.

As shown in FIG. 3, said inflatable bladder in its deflated configuration comprises a downstream edge 12*b*, a first upstream edge 12*c*, a second upstream edge 12*e*, a first left edge 12*f*, a first right edge 12*h*, a second right edge 12*i*, an upper membrane 12*j*, a lower membrane 12*k*, and one or more hinge flaps 12*l*. The boundary between the inflated portion of the air bladder 12*o* and the clamped portion of the bladder 12*n* of said air bladder is designated as 12*m* in FIG. 3.

No reinforcing cords terminate within the inflated portion 12*o* of the bladder 12. All reinforcing cord terminations are located along the first left marginal edge 12*f*, the first right marginal edge 12*h*, the second upstream marginal edge 12*e*, or the first upstream marginal edge 12*c*. Hoop tension loads generated within the inflatable portion 12*o* of the bladder 12 are transmitted to the clamping system and spillway within the clamped portion 12*n* of the bladder 12. This invention thus provides a bladder 12 wherein elastomer shear stresses within the safety and longevity critical inflatable portion 12*o* of the bladder 12 are extremely low. This invention further provides that the reinforcing cords within the inflated portion of the bladder are very uniformly loaded and thus can be designed to have a uniformly high factor of safety.

Referring again to FIG. 3 the first step in constructing the invention is to create an inner liner 12*d* which covers the inner surface of the upper membrane 12*j* and lower membrane 12*k* and is continuous at the inner surfaces of the downstream edge 12*b*, the second left edge 12*g* and the second right edge 12*i*. The innerliner may extend to the first upstream edge 12*c* and the second upstream edge 12*e*, being bounded by the first left marginal edge 12*f* and the first right marginal edge 12*h*. Alternatively said innerliner 12*d* may only extend upstream 12*q* to the extent 12*m* of the inflated portion of the bladder. Said inner liner 12*d* in FIG. 2*a* is generally not reinforced with cords, its purpose being to create a gas impermeable layer so that the reinforcing cords and their associated elastomers are not in direct contact with the media used to pressurize the inflatable bladder. Referring again to FIG. 3 the second step is to add to the inner liner 12*d* a reinforced elastomeric sheet 13*a* in a direction +45 degrees from the left marginal edges 12*f* and 12*g*. Said layer 13*a* is also shown in FIGS. 2.2*a*,2*b*,2*c*, and 20*c*. Individual reinforcing cords within said reinforced elastomeric sheet 13*a* each begin and terminate along either the first left marginal edge 12*f*, the first right marginal edge 12*h*, the second upstream marginal edge 12*e* or within the hinge flaps 12*l*. Said individual reinforcing cords are continuous and without splices or terminations within the inflatable portion of the bladder. Said reinforcing cords wrap around the second left marginal edge, the second right marginal edge and/or the downstream marginal edge 12*b*. begins at the upstream edge on the top face, is wrapped around the downstream edge onto the bottom face and terminates on the bottom face along the upstream edge. This process is followed by application of a second layer of reinforced elastomeric sheet for which the direction of reinforcement is in a direction −45 degrees from the left marginal edges 12*f* and 12*g*. This layer is shown in FIG. 2 as 13*b*. The fourth step (optional) is to wrap the first three layers of material in a direction so that the reinforcing cords run parallel to the left and right edges. Again starting on the upper membrane 12*j* at the second upstream marginal edge 12*e*, reinforced elastomeric material is wrapped around the downstream edge onto the bottom membrane 12*k* and then terminates at the first upstream marginal edge or within the hinge flaps 12*n*. This layer is also shown in FIG. 2 as 13*c*. This fourth step is optional because depending on the application, sufficient bladder strength may be obtained by running the reinforcing cords in only the +45 and −45 degree directions. The order in which the directionally reinforced layers are laid up is discretionary. The strength of each layer and the total number of layers is in accordance with the working loads and desired safety factor. Lastly an optional unreinforced sheet of elastomeric material can be wrapped to provide an abrasion and weather resistant cover. This cover is also shown in FIG. 2 as 13*d*.

Figure 3A:
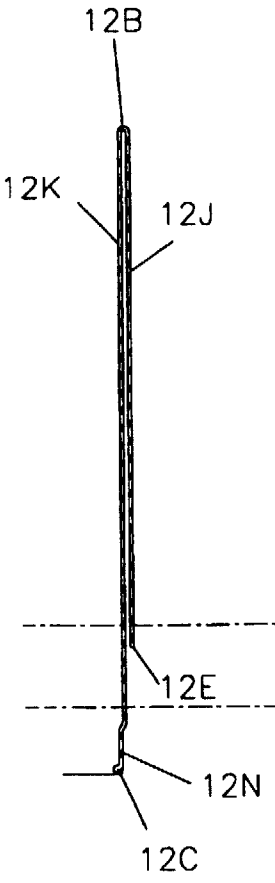
FIG. 3*a* is a sectional view of the not yet folded inflatable bladder taken along line 3*a*—3*a* in FIG. 3
Figure 3B:
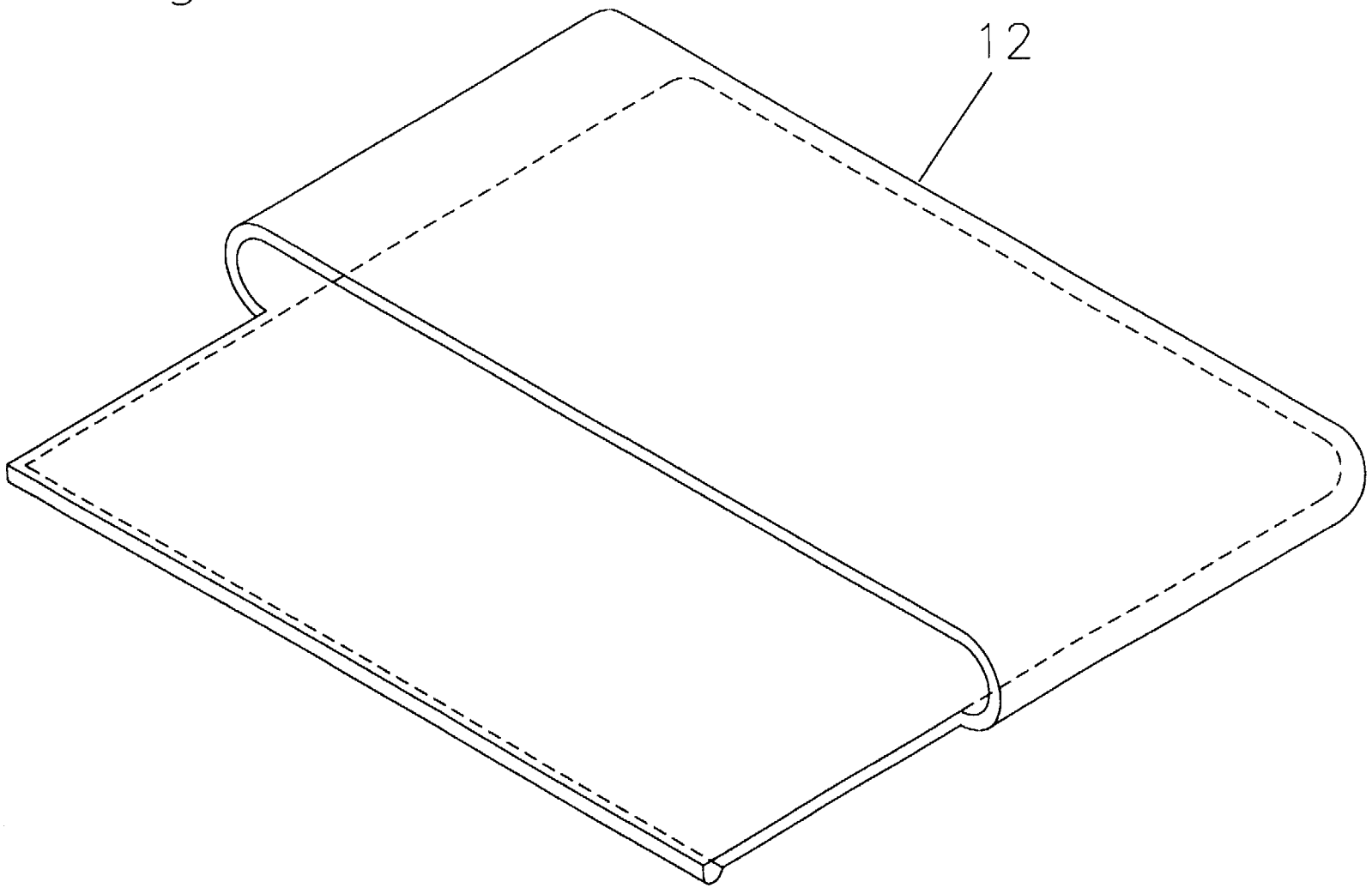
FIG. 3*b* is a perspective view of an inflatable bladder not yet folded.
Figure 3C:
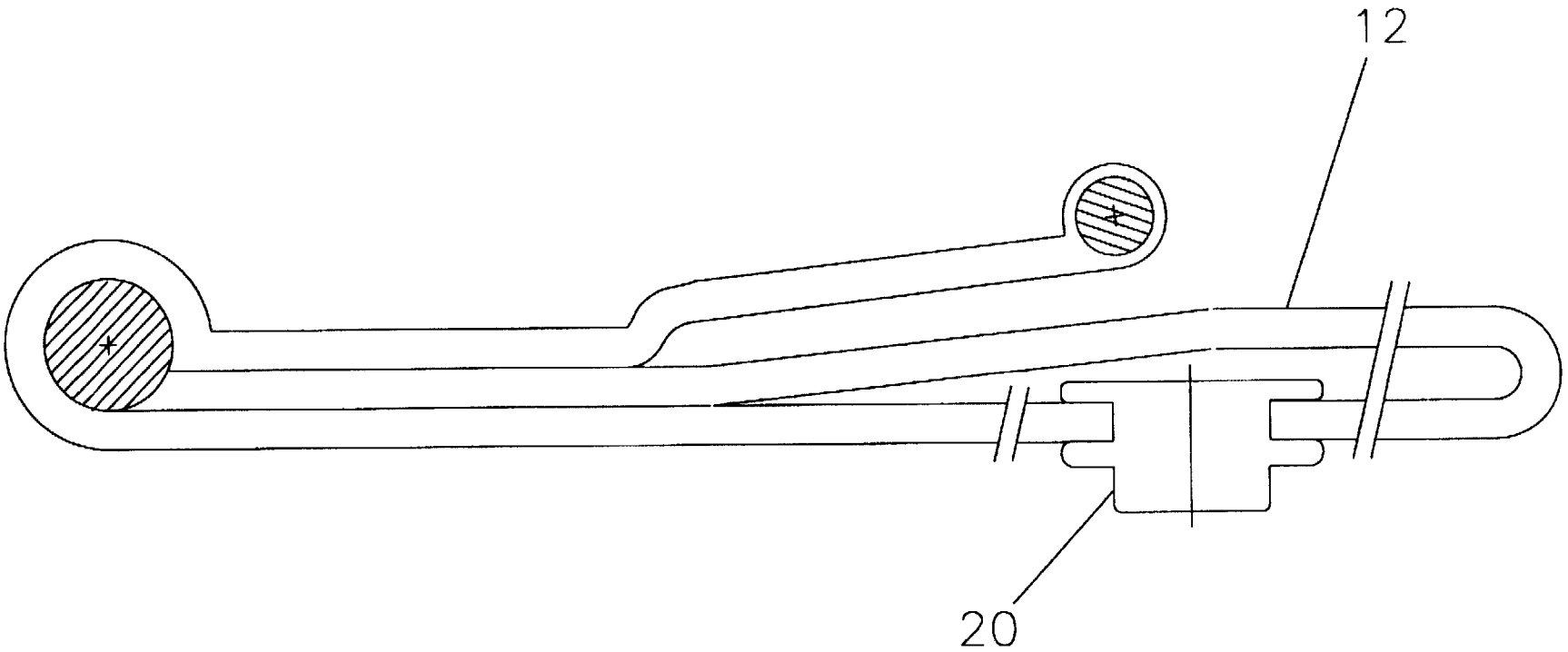
FIG. 3*c* is a sectional view of the bladder of FIG. 3*b* after folding and addition of the upstream insert.
Figure 3D:
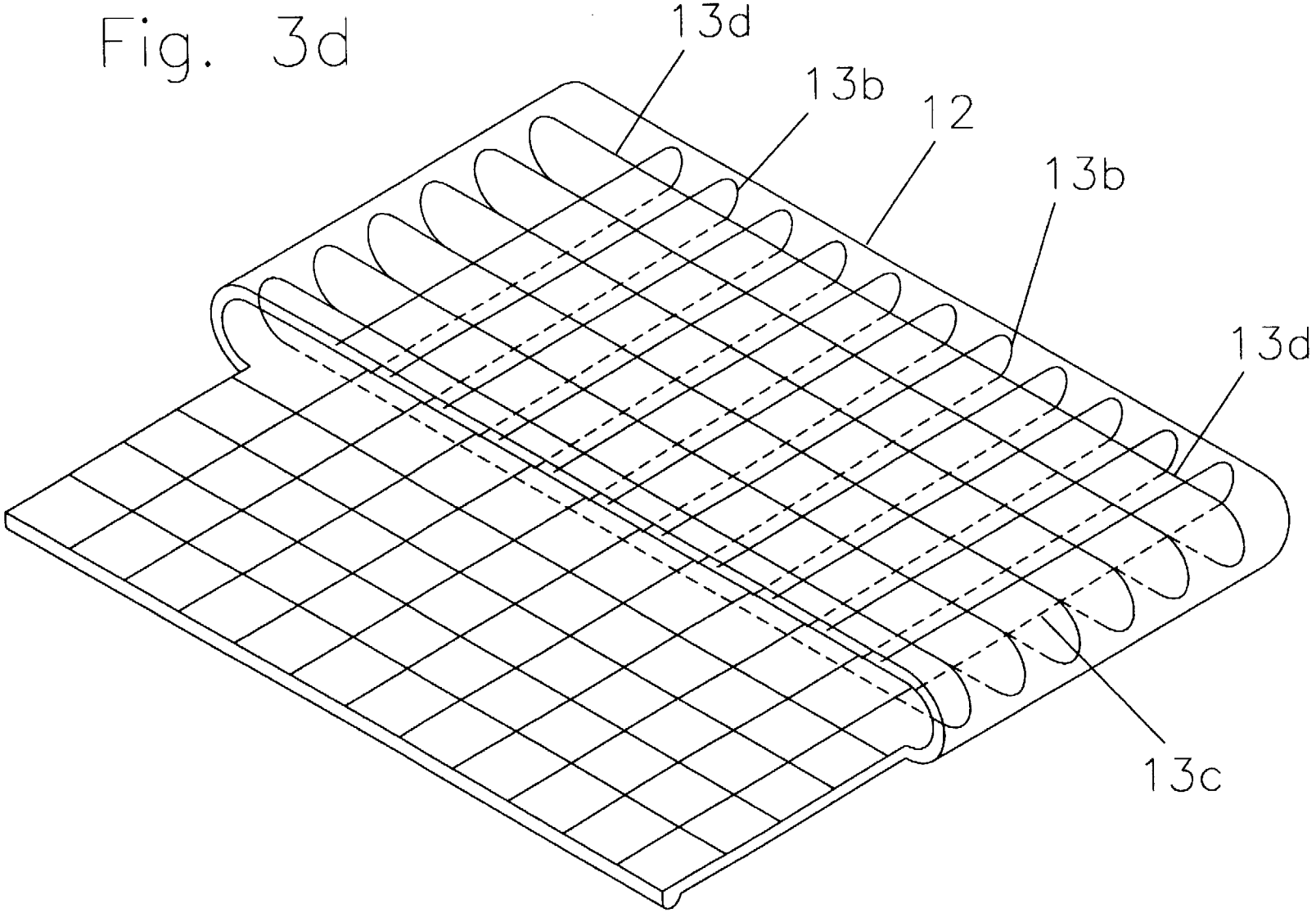
FIG. 3*d* is a perspective view of the inflatable bladder of FIG. 3*b* showing an example of functional but not optimal configuration of tire cord type reinforcement.
Figure 3E:
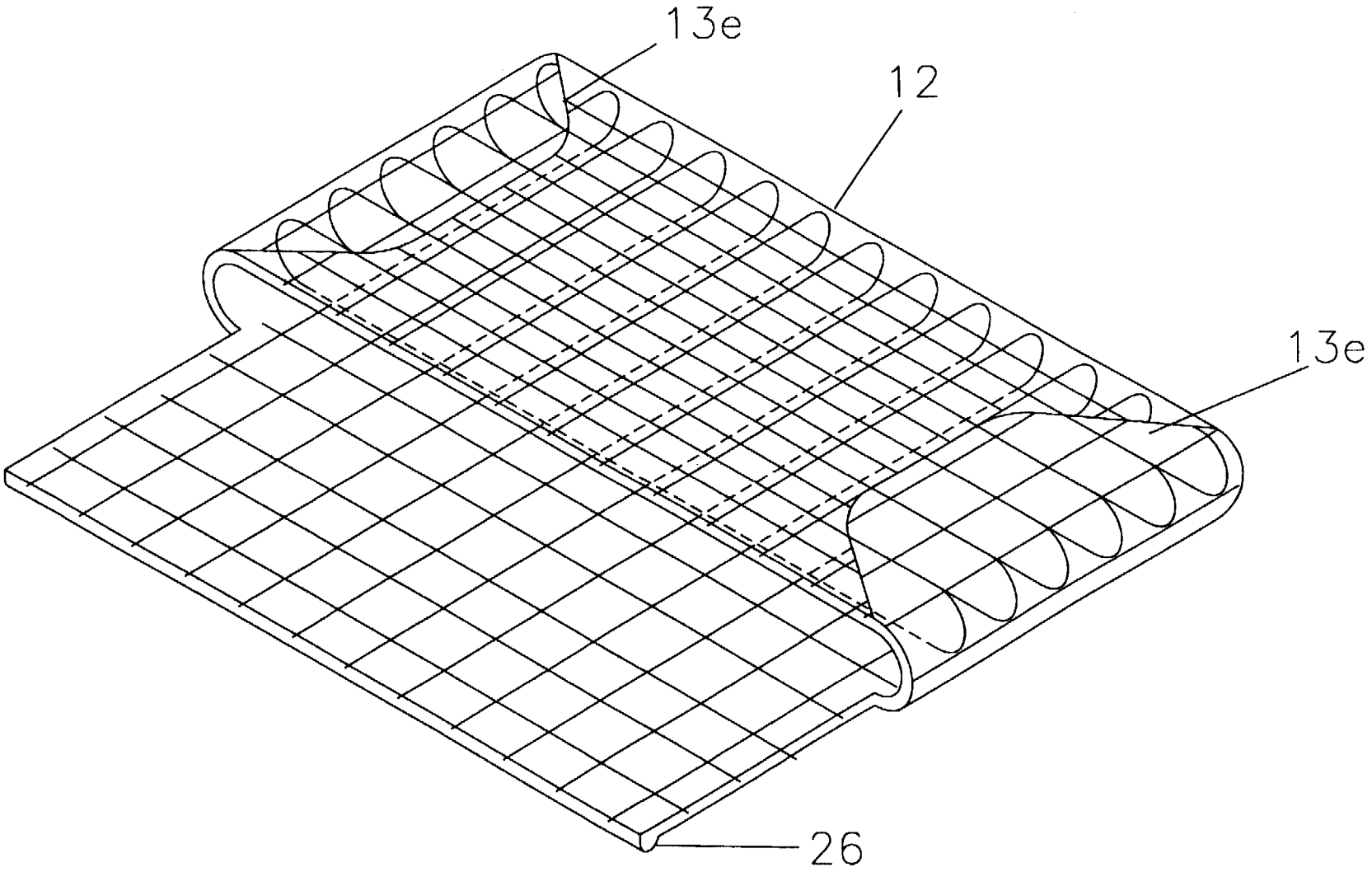
FIG. 3*e* is a perspective view of the inflatable bladder of FIG. 3*b* showing an example of the use of square woven reinforcement and associated splices.

Other orientations of fibers as well as other types of calendered fabrics may be used in laying up the air bladders although such other methods may not result in the most efficient use of materials and may result in undesirable joints and stress concentrations within the inflated and stressed portions of the bladder. FIG. 3*a* and FIG. 3*b* illustrate the lay-up of an integrally vulcanized bladder with non optimum reinforcement.

FIG. 3*a* illustrates the use of a warp only tire cord fabric to reinforce the air bladder with one layer of calendered fabric 13*b* in the circumferential direction and one layer 13*c* plus an additional layer 13*d* at a splice.

FIG. 3*b* illustrates the use of a calendered square woven fabric to reinforce the air bladder. One layer of fabric is shown at all locations except at the end flap splices and around the inset 26 on the hinge flap.

For crest gate applications which involve fastening a steel gate panel to the inflatable bladder an incompressible insert composed of a material such as nylon or rubber rod can be inserted along the upstream edge of the bottom face. Turning to FIG. 2*a*, by wrapping one or more layers of the reinforced elastomeric sheet around this insert 26, a bead is created along the downstream edge of the inflatable bladders hinge flap. The inflatable bladder can then be fastened to the gate panel by means of hinge retainers as shown in FIG. 1. By incorporating an incompressible insert into the inflatable bladder hinge a much stronger and reliable connection between the inflatable bladder and the steel panel can be assured than methods using prior are methods.

After curing the above bladder in an autoclave, for example, the next step is to seal the inflatable bladder in a secondary vulcanization process. As shown in FIG. 2*a* the longer portion of the open envelope is wrapped around an incompressible insert 24 and then back on itself. This vulcanization process creates that portion of the inflatable air bladder that is fastened to the spillway in FIG. 1 by the clamp bar and anchor bolt.

Figures 4, 4A:
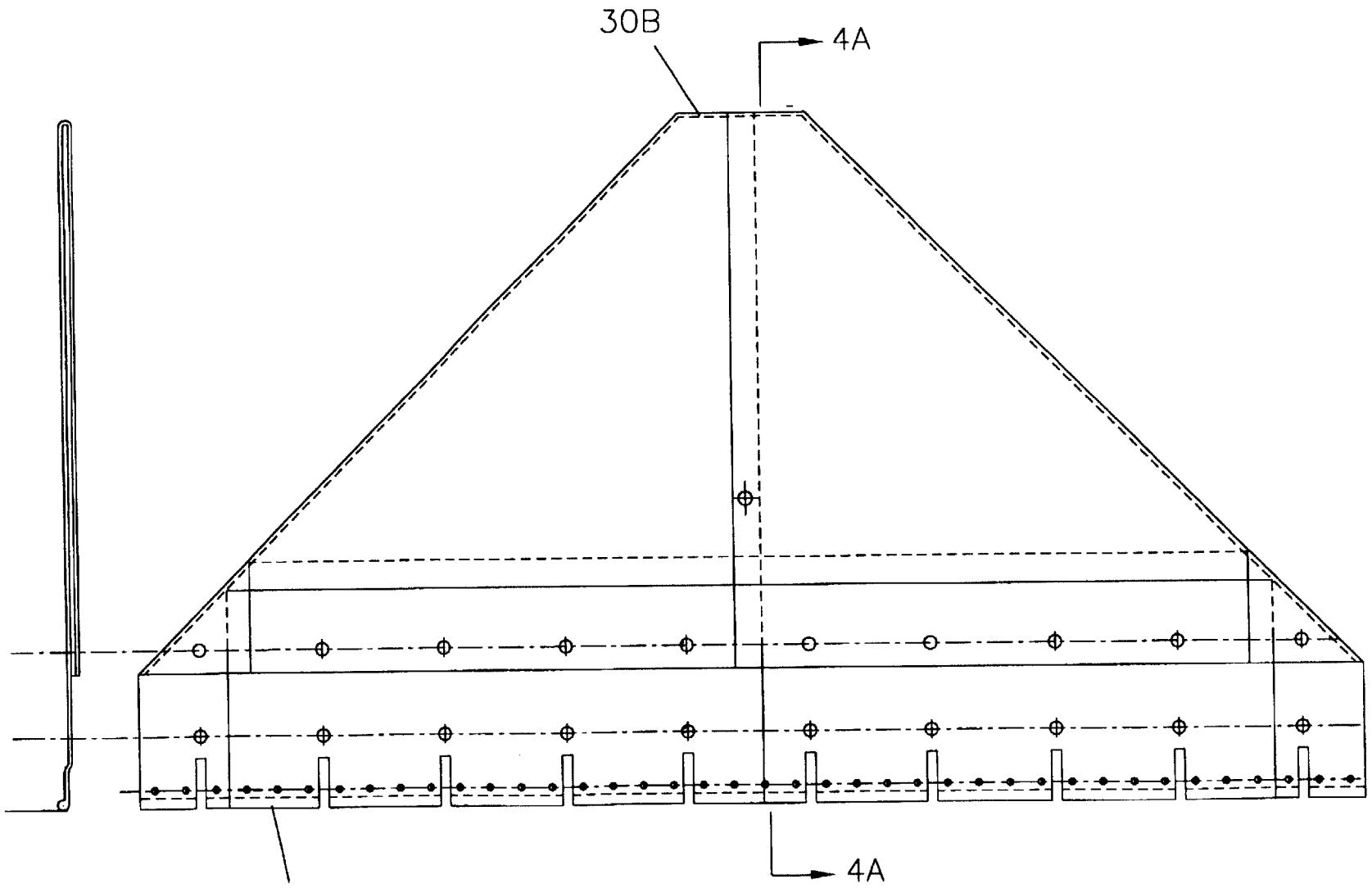
FIG. 4 is a top view illustrating the orientation of reinforcement layers in an inflatable bladder of this invention for use on curved sections of spillway.
FIG. 4*a* is a sectional view of the not yet folded inflatable bladder taken along line 4*a*—4*a* in FIG. 4.

The configuration of the above inflatable bladder is for use on straight dam spillway sections. However, since many spillway sections are curved, a bladder 30 as shown in FIG. 4 is used. A bladder of this type consists of an upstream edge 30*a*, a downstream edge 30*b*, a left edge, a right edge, a top face, and a bottom face. The only difference in manufacturing this type of bladder as opposed to the above mentioned is the method in which the uncured unidirectionally reinforced elastomeric sheet is initially laid up. The first layer begins at the upstream edge on the top face. The reinforcing cords are then wrapped around the right edge and onto the opposite face. By doing this the direction of reinforcement changes direction by 90 degrees on the opposite face. This gives the bottom face of the bladder its longitudinal strength. The elastomeric sheet is then wrapped around the left edge thereby changing the direction of reinforcing and then terminates at the edge of the original face. The second layer of unidirectional reinforced elastomeric sheet begins on the bottom face on the upstream edge and gets wrapped around the right edge onto the top face. Once again this changes the direction of the reinforcing thereby giving the top face its longitudinal strength. The elastomeric sheet is then wrapped around the left edge of the bladder thereby changing the reinforcing direction and terminates on the lower face at the downstream edge. The last remaining reinforcement layer begins on the upstream edge of the top face and is then wrapped around the downstream edge onto the bottom face and terminates at the upstream edge of the bottom face. Once again, additional reinforcing layers can be added to strengthen the bladder and an inner liner and outer cover can be added if desired. This envelope is also cured in an autoclave, for example, and then sealed in a secondary vulcanization process as described above in connection with FIG. 2*a*.

Figure 5:
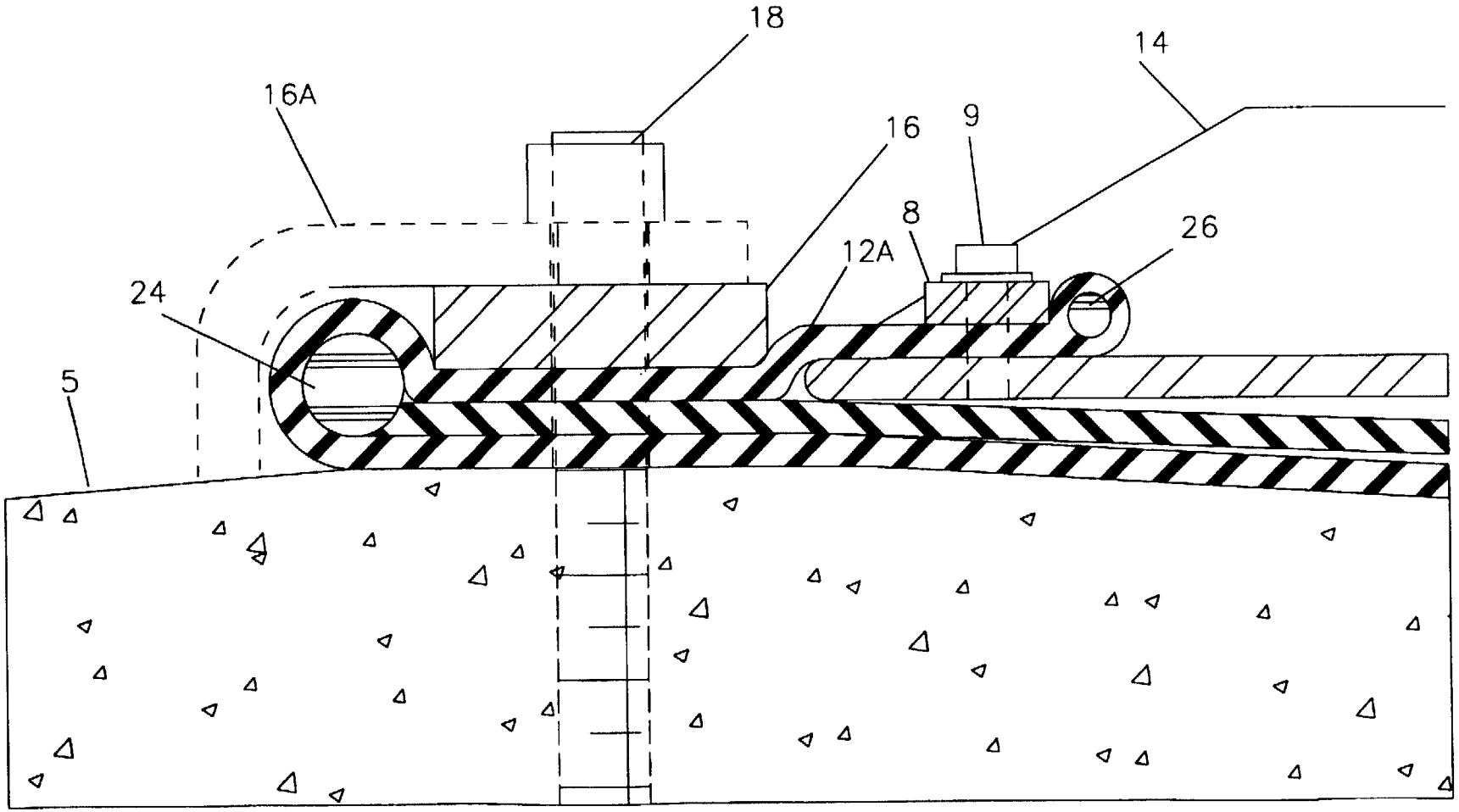
FIG. 5 shows how the inflatable bladder of this invention is clamped to the spillway and to the steel gate panels.

Referring to FIG. 5 the upstream portion of the inflatable bladder and steel gate assembly of FIG. 1 is shown. The bladder itself is fastened to the spillway by a clamp bar 16 and anchor bolt 18. This seam of the inflatable bladder which is under the clamp bar 16 is that which is bonded in the secondary vulcanization process. As can be seen, the insert 26, that is inserted in the upstream portion of the inflatable bladder prior to the secondary vulcanization process makes it virtually impossible for the inflatable bladder to pull out from under the clamp bar. The inflatable bladder is then connected to the steel gate panel 14 by means of one or more hinge retainers 8 and screws 9. The incompressible insert 24 that was inserted into this hinge flap portion of the bladder makes it virtually impossible to pull the steel gate panel away from the hinge flap and thus the inflatable bladder. This improvement on prior technology makes the crest gate system capable of withstanding higher loads and is more suitable for construction in larger (higher) sizes.

Figure 6A:
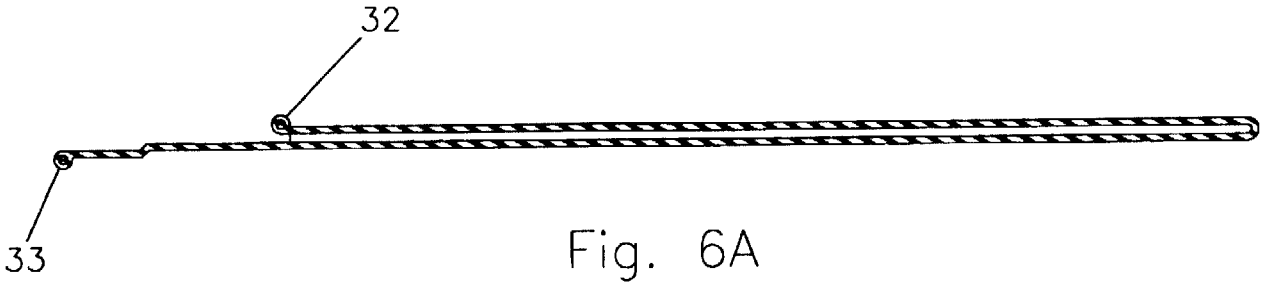
FIG. 6*a* shows the bladder cross section prior to folding when the secondary vulcanization process is not used
Figure 6B:
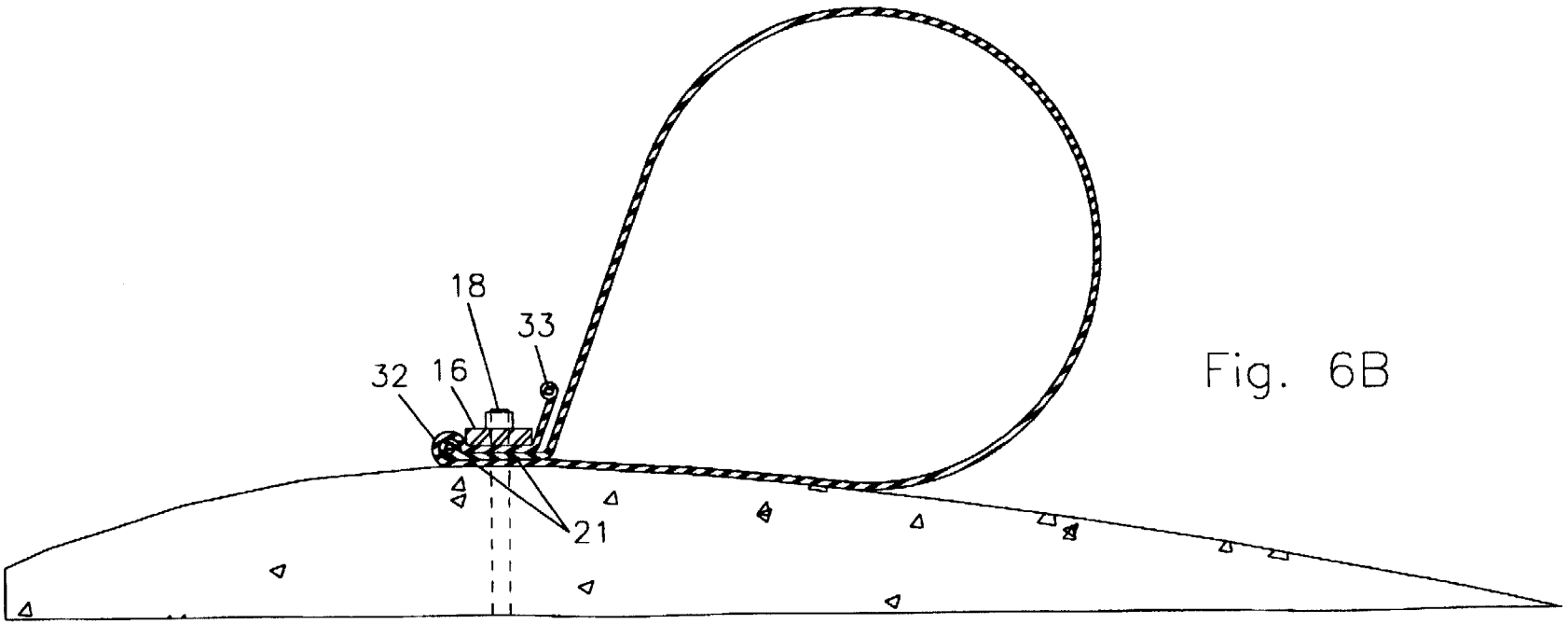
FIG. 6*b* shows the inflatable air bladder of FIG. 6*b* folded and clamped to the dam spillway.

A method by which the envelope portion of the inflatable bladder can be sealed without the secondary vulcanization process is shown in FIG. 6. Using this method enlarged beads 32 and 33 with associated incompressible inserts are formed on the top face and bottom face of the upstream edges while the envelope is built up on the mandrel. After the envelope is cured the inflatable bladder is then sealed using only an anchor bolt(s) 18 and clamping means 16 as shown in FIG. 6*b*. In FIG. 6*b* it can be seen that the enlarged bead upstream of the clamp bar creates a restraining means that does not allow the sealed portion of the inflatable bladder envelope from slipping from out of the clamp bar mechanism.

Figure 7:
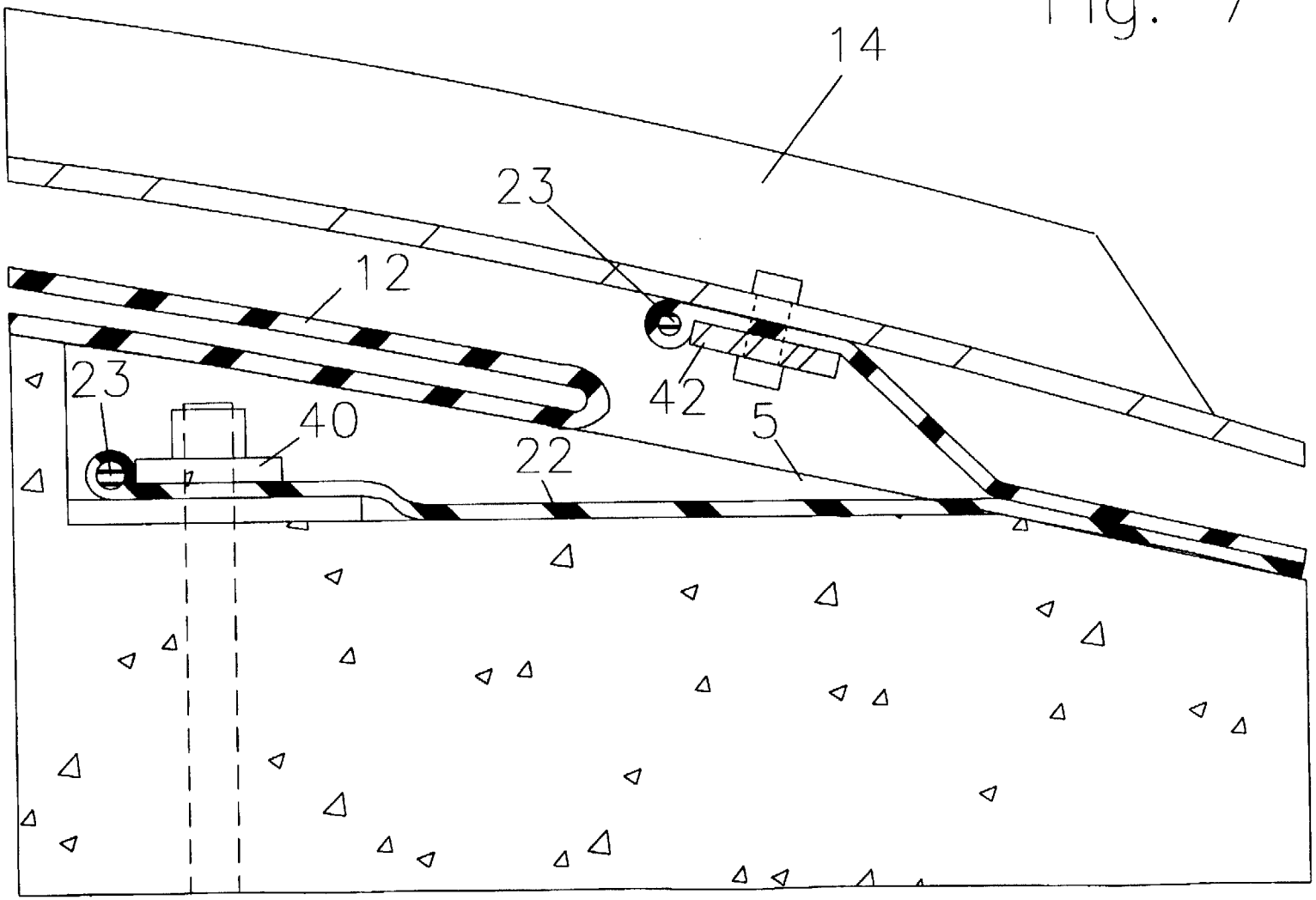
FIG. 7 illustrates the gate system of FIG. 1 in the lowered position and illustrates the restraining method incorporated into a crest gate system in accordance with the present invention.

FIG. 7 shows another aspect of the invention. As shown in FIG. 1 one method of restraining the crest gate system is by means of a restraining strap 22 which is anchored to the spillway downstream of the inflatable bladder and to the bottom face of the upper portion of the steel gate panel. Old technology relied on serrated retainer clamps to insure that the restraining strap was held in position. As seen in FIG. 7 an incompressible insert 23 is introduced to the restraining strap upstream of the spillway retainer clamp 40 and upstream of the gate panel retainer clamp 42. When the gate is in the fully raised position these beads prevent the restraining strap from sliding out from under the restraining clamps. FIG. 7 shows the gate panel in its lowered position, with the inflatable bladder deflated.

Figure 8A:
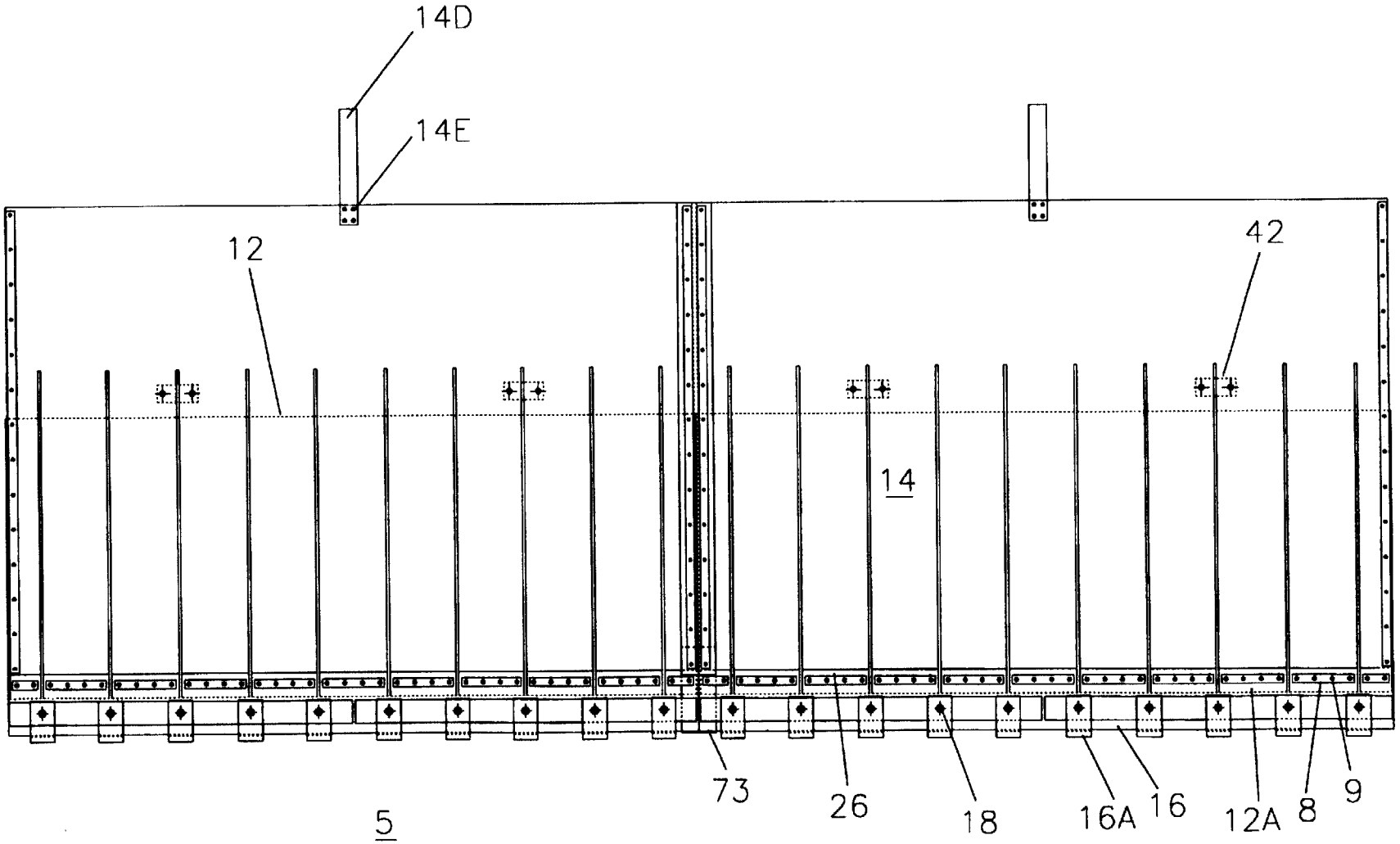
FIG. 8*a* shows the region between adjacent inflatable bladders in a crest gate system where the interbladder membrane seal is located.
Figure 8B:
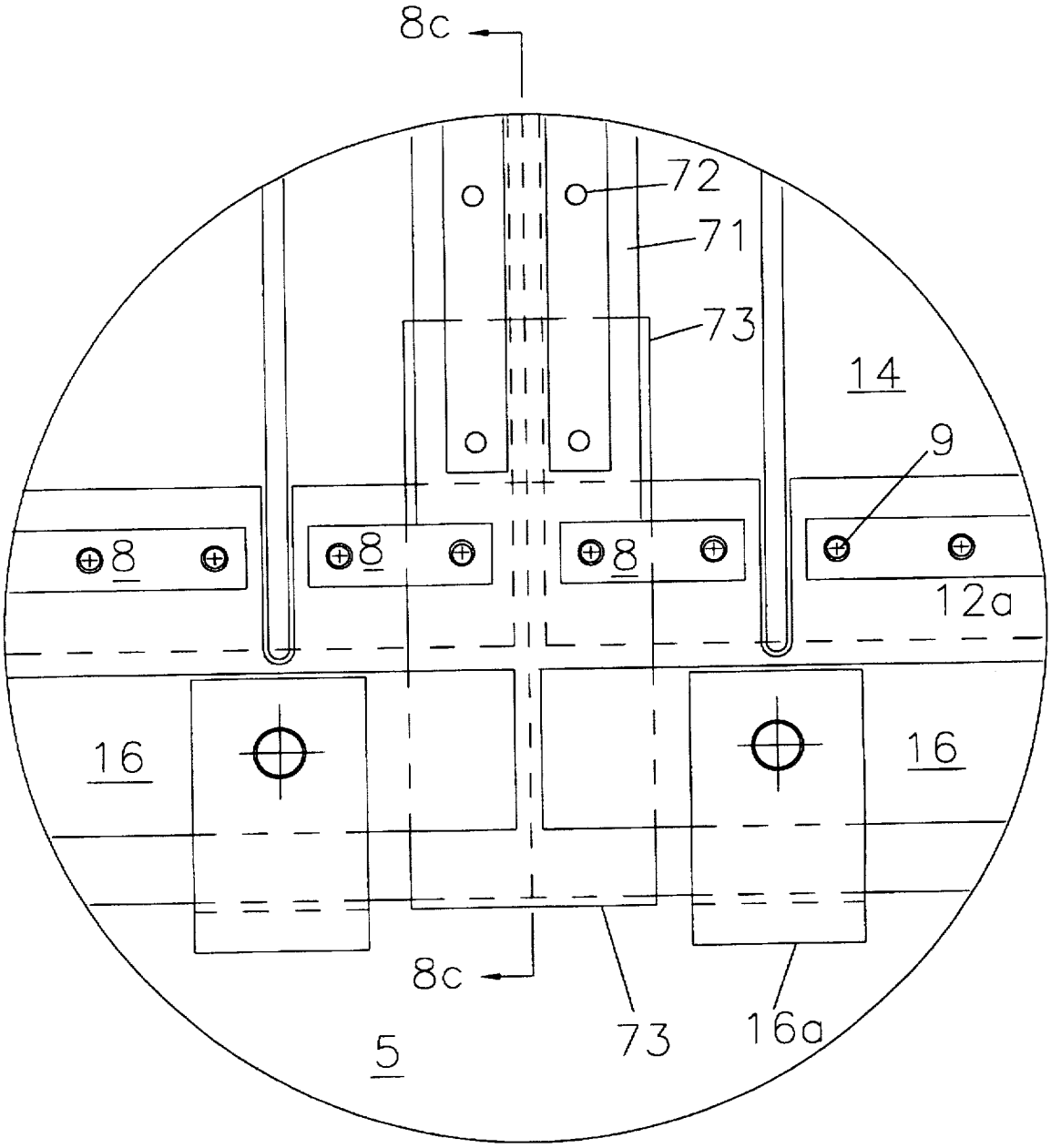
FIG. 8*b* is an enlarged detail of the interbladder seal shown in FIG. 8*a*.
Figure 8C:
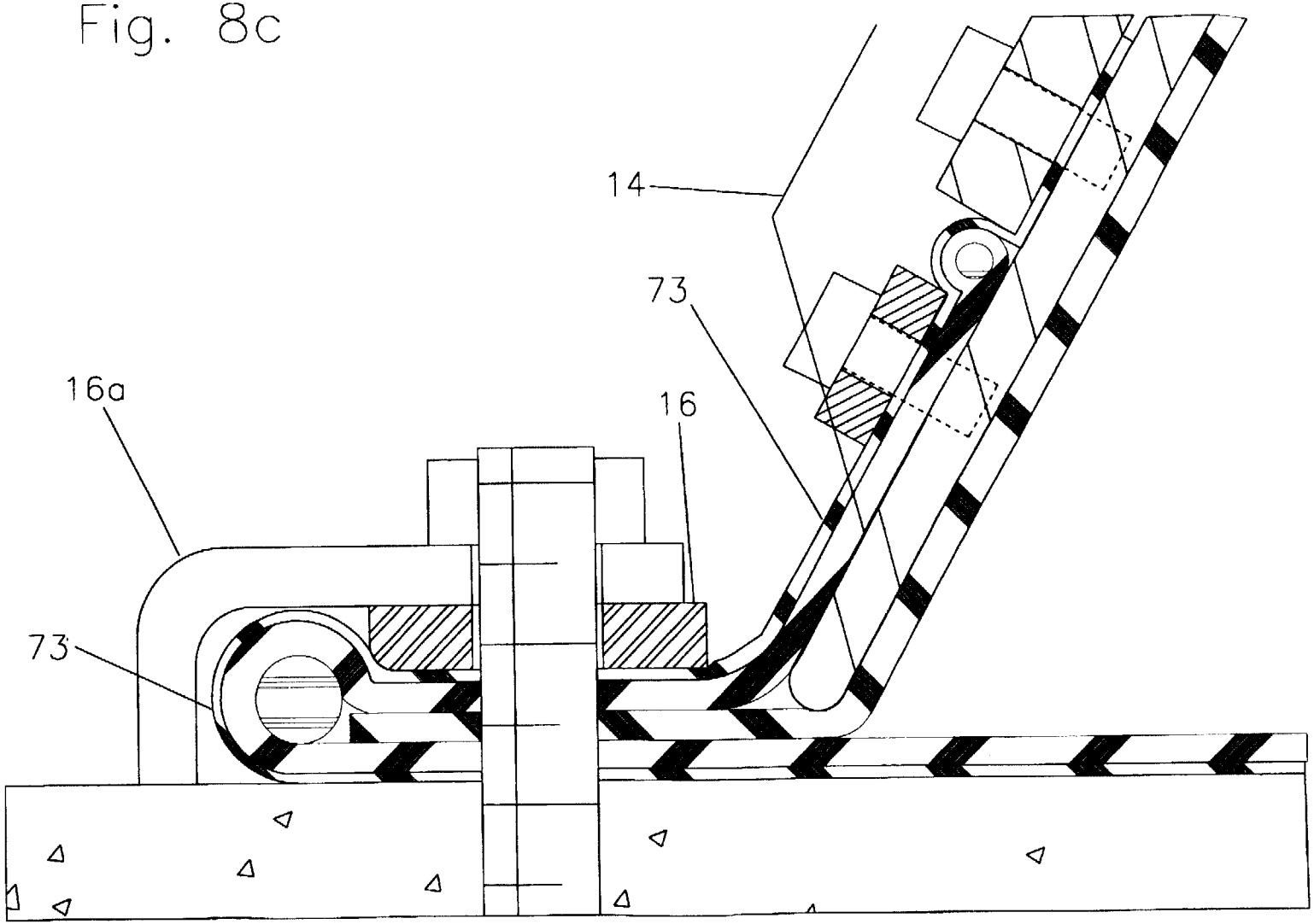
FIG. 8*c* is a sectional view of 8*a* and 8*b* taken along line 8*c*—8*c* in FIG. 8*b* illustrating the interbladder seal.

FIG. 8*a* shows two gate panels 14 on top of two inflatable bladders. Prior to this invention, the gap between the adjacent inflatable bladders would leak water. By placing a thin membrane liner 26 under the inflatable bladders and then wrapping it around the upstream bead under the clamp bars, over the hinge flap and under the web retainer and web, and sealing it in place, this water leakage is eliminated.

Figure 9A:
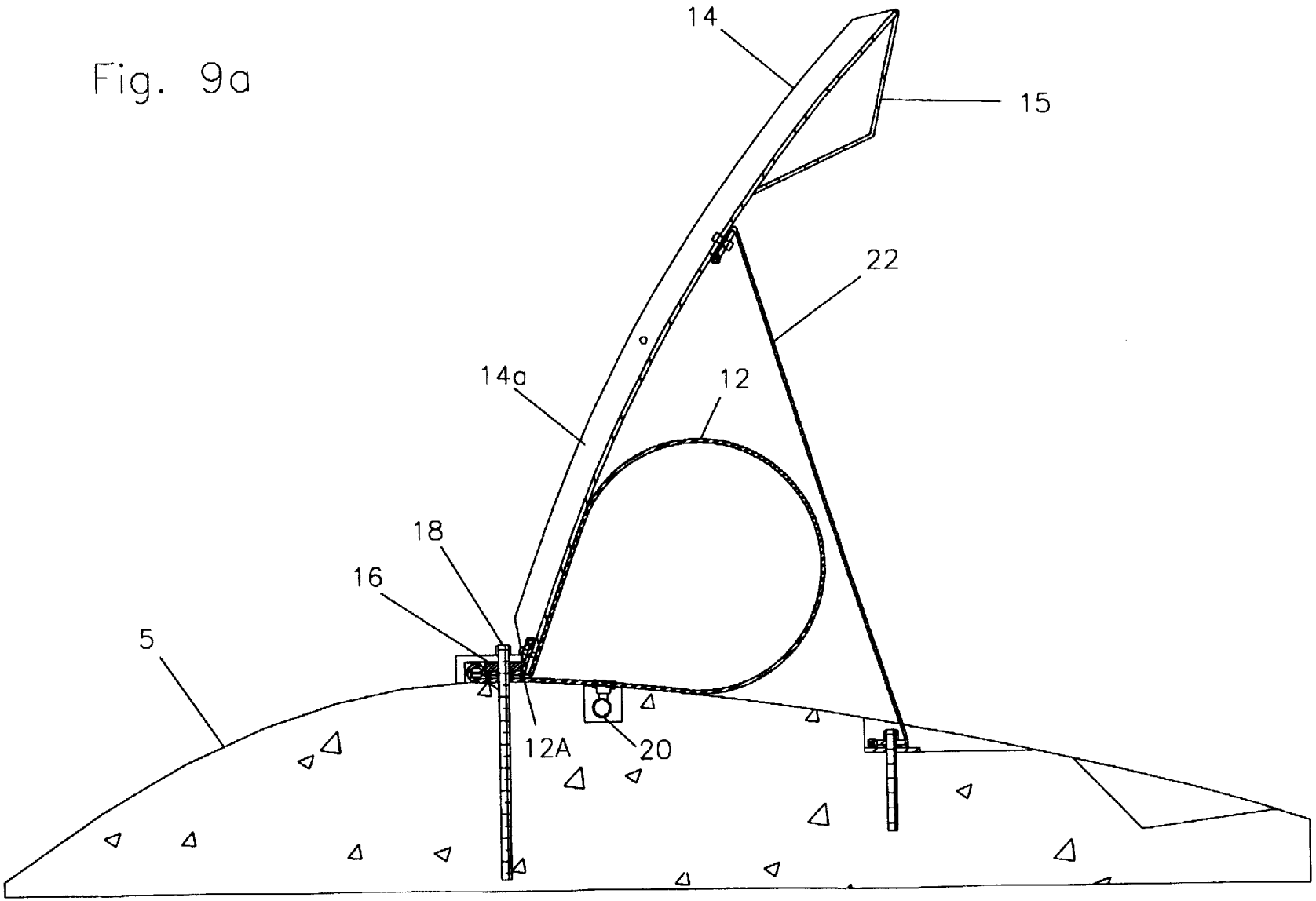
FIG. 9*a* illustrates the use of an enclosed chamber or torque tube on the bottom of the gate near the downstream edge of the gate panel.

FIG. 9*a* shows a crest gate system consisting of an inflatable bladder 12, anchor bolts 18, steel gate panels 14, and a means of restraining said crest gate system. For larger scale systems for which the economic plate thickness is relatively less the steel gate panels can be undesirably flexible in torsion in the longitudinal direction. By incorporating an enclosed chamber 15 in the downstream portion of the steel gate panel the torsional rigidity is enhanced. This resulting torque tube gives the steel gate panel enhanced torsional strength and rigidity thereby allowing the construction of large crest gates using steel plate of moderate thickness.

Figure 9B:
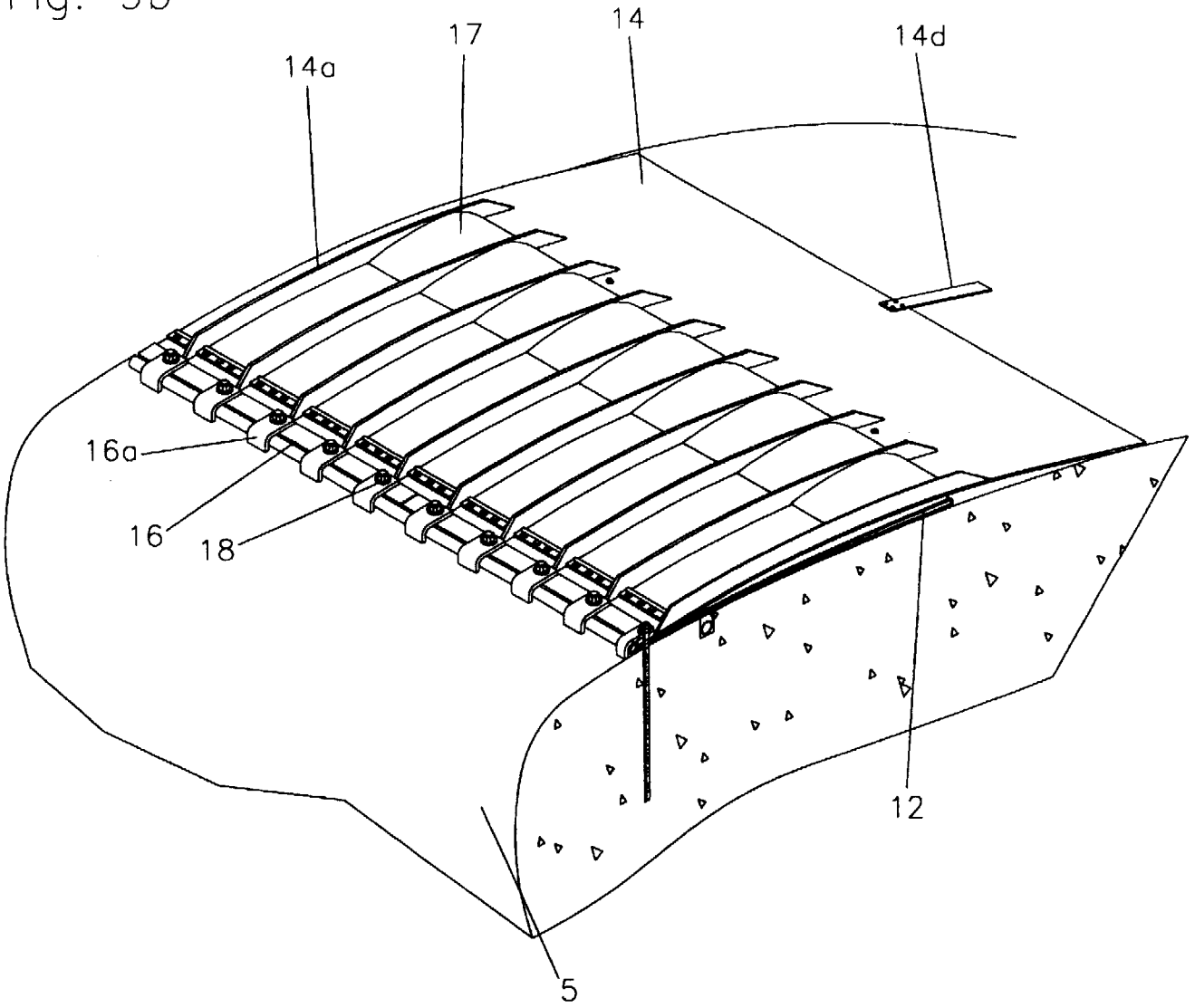
FIG. 9*b* illustrates the use of a torque tube structure on the top surface and downstream edge of the steel gate panel in a crest gate system.

FIG. 9*b* illustrates how the area between ribs 14*a* on the upper face of the gate panels can be spanned with rigid curved plates to form the torque tube. This method allows the bottom face of the gate panel to much more closely fit the spillway cross section 5 when in the lowered position.

Figure 10A:
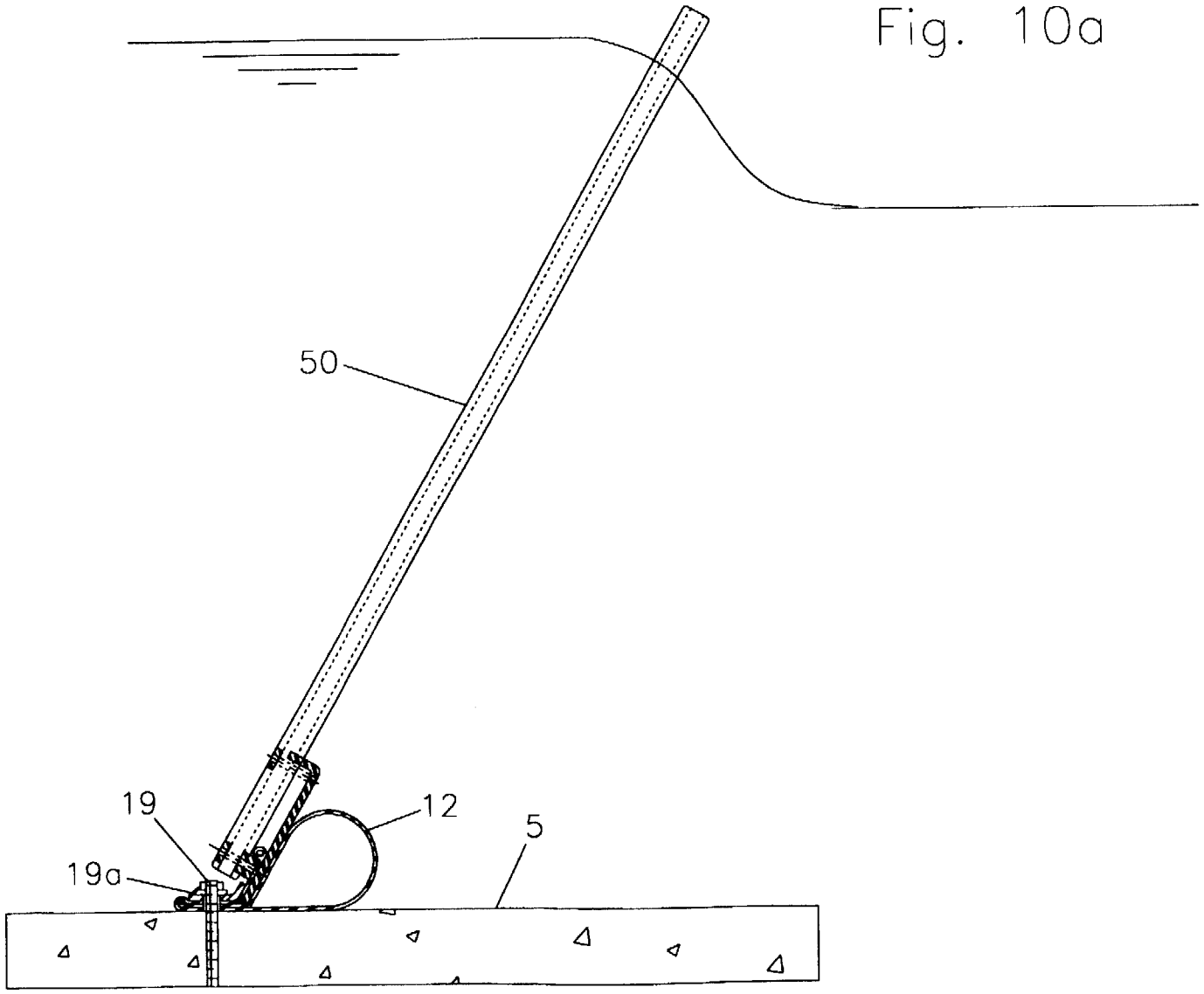
FIG. 10*a* illustrates the pickets which are attached to the present invention to provide a fish barrier.
Figure 10B:
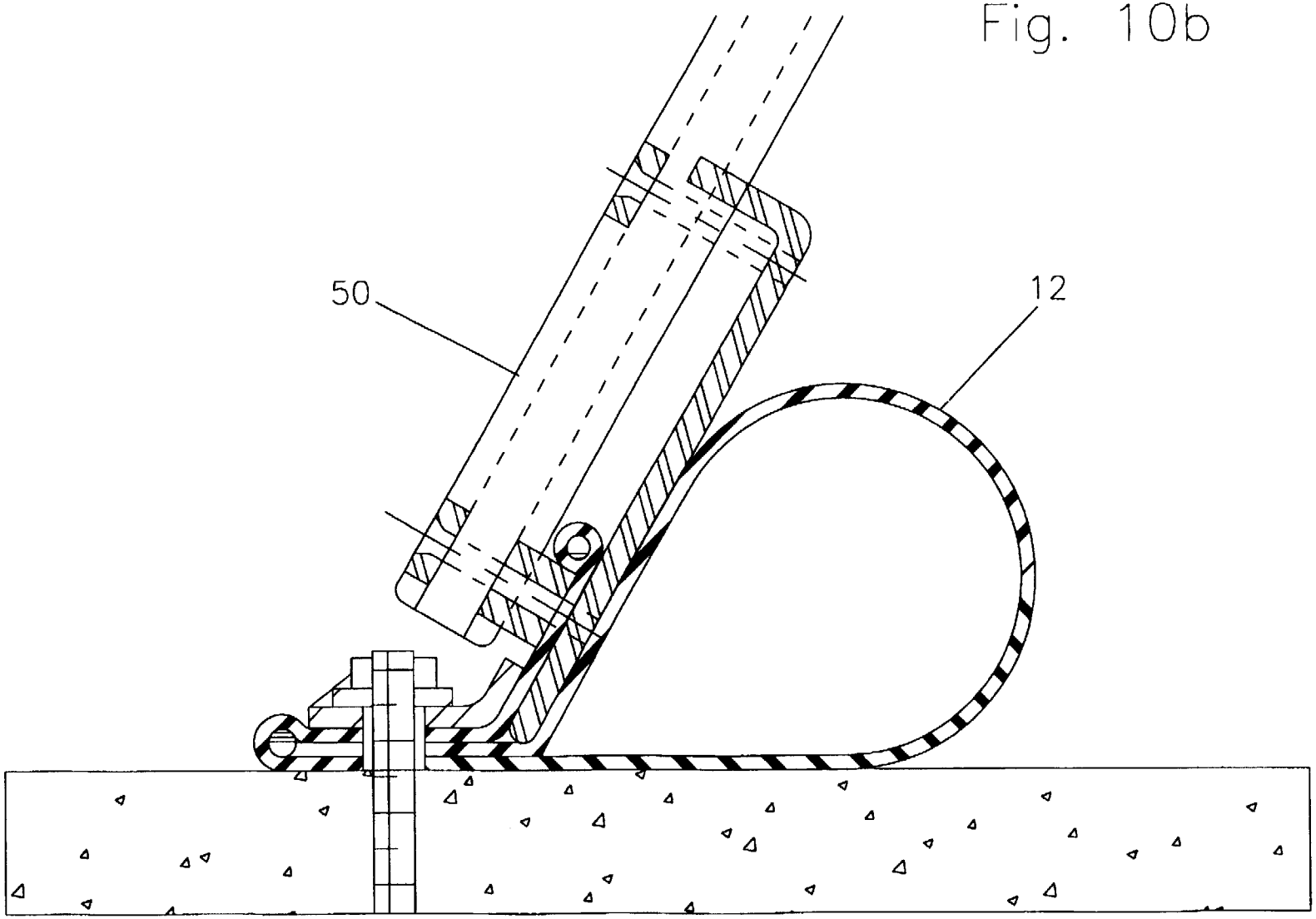
FIG. 10*b* is an enlarged detail of the gate panel and inflatable bladder used for fish barrier applications.

FIG. 10*a* and FIG. 10*b* illustrate the use of the pneumatic crest gate system as a fish barrier. FIG. 10 shows a seamless inflatable bladder 12, a gate panel 50, an anchor bolt 19, and a clamp bar 19*a* to clamp the assembly to the dam spillway. By adding closely spaced vertical rods or bars to the gate panel an effective barrier is created which allows for water flow while stopping any fish migration from areas downstream of the barrier to areas upstream of the barrier.

Figures 11, 11A:
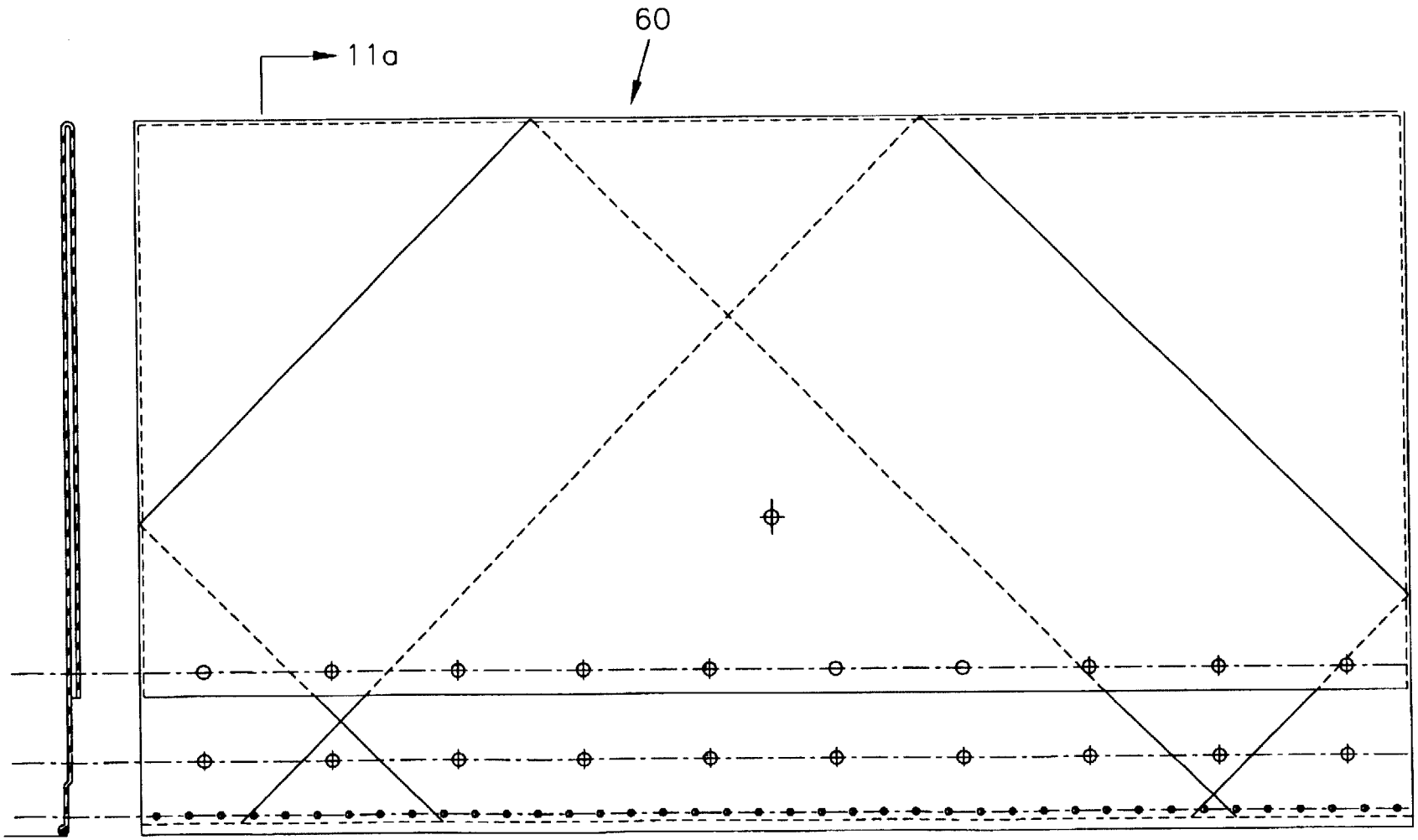
FIG. 11 illustrates a top view of another variation of an inflatable bladder of the invention in its unfolded state.
FIG. 11*a* is a sectional view of the bladder of FIG. 11 taken along line 11*a*—11*a* in FIG. 11.

FIG. 11 illustrates a seamless air bladder design 60 for use with lower inflation pressures. This air bladder is constructed in the exact same sequence as the before mentioned bladders. However, in this case only two layers of reinforced elastomeric sheet are used. The elastomeric sheet in which the reinforcing cords run parallel to the left and right edges is deleted and only the sheets with the reinforcing cords that run in the +45 degree and −45 degree direction are incorporated. Again the open envelope is sealed in a secondary vulcanization process and an incompressible insert can be inserted to create the beads at the hinge flap and along the upstream longitudinal edge of the inflatable bladder.

Figures 12A, 12C:
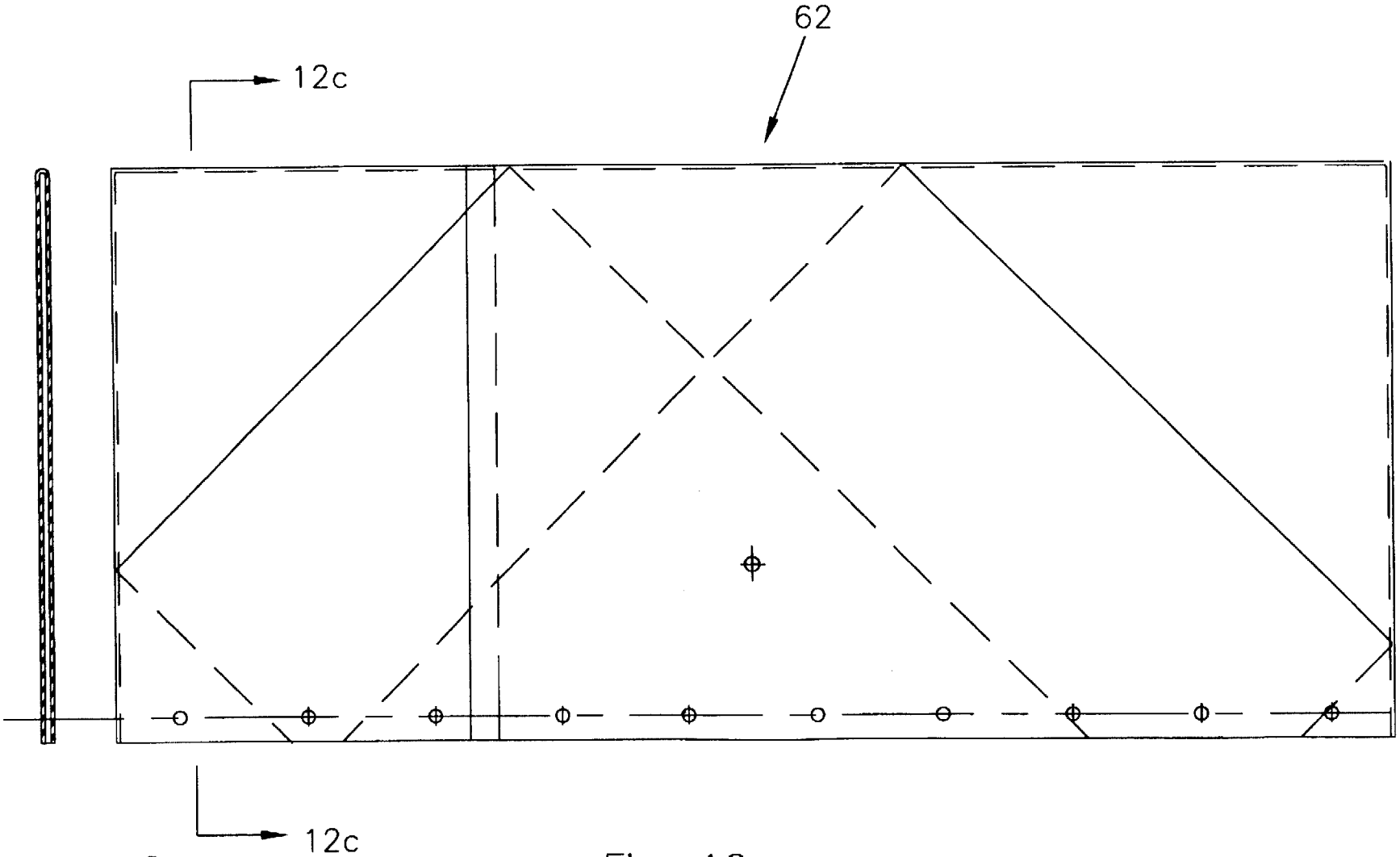
FIG. 12*a* illustrates general bladder lay-up as used in this invention.
FIG. 12*c* illustrates the bladder of FIG. 12*a* in section taken along 12*c*—12*c*.
Figure 12B:
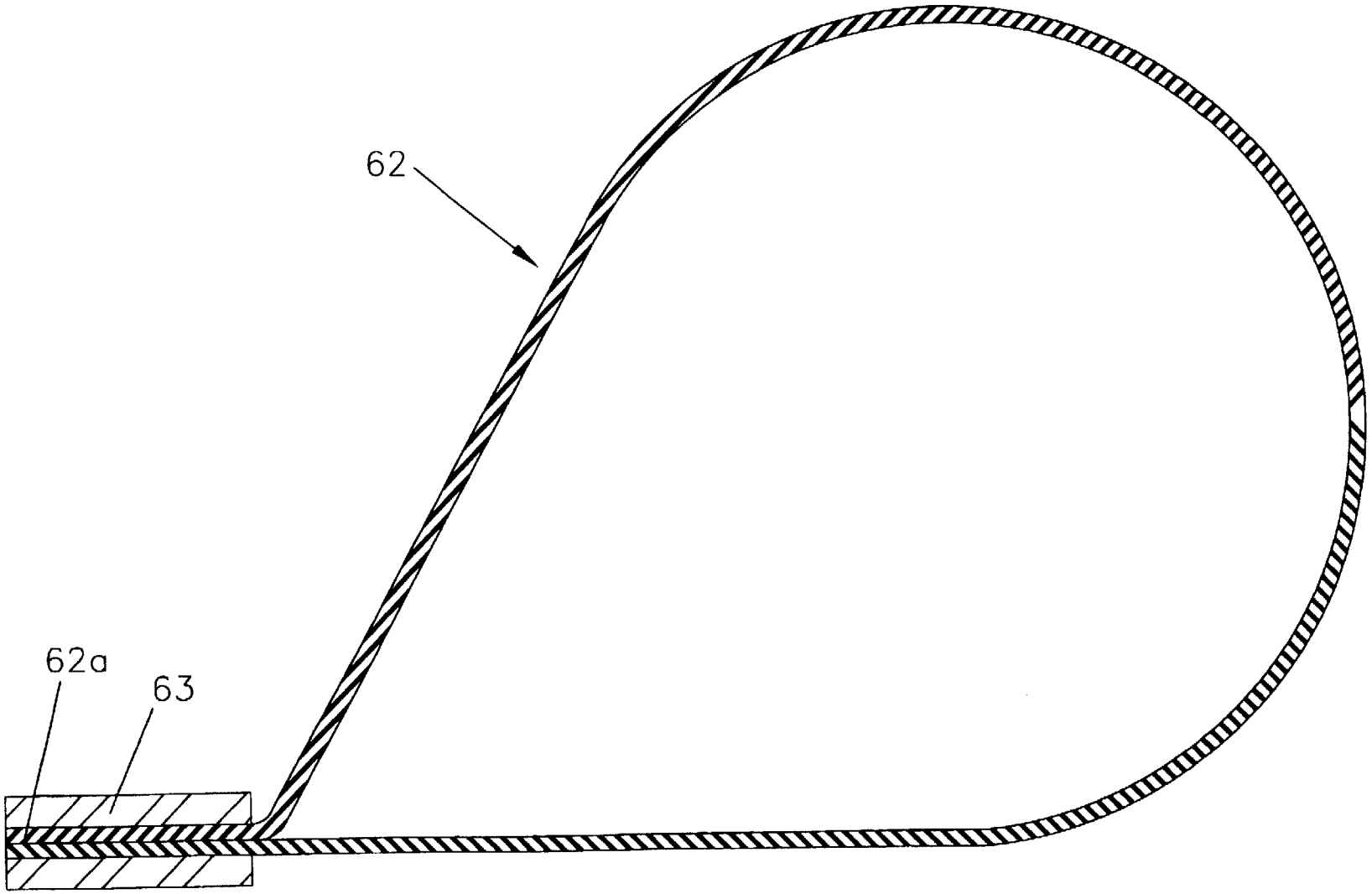
FIG. 12*b* illustrates the bladder of FIG. 12*a* in the inflated position.

Turning to FIG. 12*a* and FIG. 12*b* the simplest version of a seamless inflatable bladder 62 of the invention is shown. In FIG. 12*a* the preferred method of laying up the seamless bladder is illustrated. Three layers of unidirectionally reinforced elongated elastomeric sheet are laid up one above the other to produce an envelope with one open edge 62*a*. The layers are built up in such a way as to provide strength in the circumferential direction as well as the +45 degree and −45 degree directions with respect to the circumferential direction. The layers are also built up in such a way as to ensure that all cord ends terminate along the open edge on the top or bottom face. Alternatively, for applications that involve less pressure and therefore not as strong a of bladder, the layer of elastomeric sheet that contains the reinforcing in the circumferential direction can be eliminated. After the envelope is cured in an autoclave under heat and pressure the bladder can be sealed as in FIG. 12*b*. A clamping mechanism such as clamp bars 63 can provide a mechanical seal. A vulcanization process can also be used across this open edge to ensure a complete seal. By terminating all cord ends at this clamped edge the process creates an inflatable bladder which is not weakened by having reinforcing cord ends terminate in regions subject to inflation and high tensile stress.

Turning ahead to FIG. 13*a* and FIG. 3*b* these drawings illustrate another variation of the inflatable air bladder described in the previous paragraph. Again three layers of unidirectionally reinforced elastomeric sheet are built up to create an envelope with one open edge. However in constructing this bladder the bottom face is extended further upstream than the top face. As seen in FIG. 13*b*, this allows for the insertion of an incompressible insert 64 upstream of the clamping mechanism during the secondary vulcanization process. This incompressible insert creates an enlarged bead that helps counteract the pullout force that the bladder exerts on the clamp bar when inflated.

Looking at FIG. 14*a* and FIG. 14*b* a variation of the bladder described FIG. 12 and FIG. 13 is shown. As seen in figure FIG. 14*a* the lay-up of the envelope is the same as in FIG. 13*a*. However, in FIG. 14*b* a piece of reinforced elastomeric sheet 65 is placed between the upper clamping mechanism and the clamped portion of the inflatable bladder. This hinge flap provides a means by which other desired components can be attached to the inflatable bladder assembly.

FIG. 15*a* and FIG. 15*b* shows an inflatable bladder where the hinge flap 66 is integral to the bladder envelope itself. In this case the bladder envelope is built up from elongated elastomeric material as in previous paragraphs. In FIG. 15*a* the bottom face is quite a bit longer in the upstream direction than the top face. This bottom face is then wrapped around an incompressible insert 64 as in FIG. 15*b* and back on to itself. However in this case there is sufficient material to produce the hinge flap.

FIG. 16*a* and FIG. 16*b* shows an inflatable bladder with integral hinge flap 66 with enlarged bead 66*a*. Once again the bladder envelope is built up from directionally reinforced elastomeric sheet such as calendered tire cord fabric. In this case an incompressible insert 66*a* such as nylon rod is inserted along the upstream edge of the bottom face during initial layout. This insert 66*a* is then cured with the bladder and forms the enlarged bead 66*a* of the hinge flap 66 as shown in FIG. 16*b*. The inflatable bladder is then sealed in a secondary vulcanization process and mechanically joined by clamping means 63. The enlarged bead provides a very strong means of fastening the inflatable bladder to other desired components. Again the seamless inflatable bladder is clamped by two clamping plates 63. However in this case an incompressible insert 64, such as nylon, is inserted into the bladder in the longitudinal direction prior to the secondary vulcanization process. This creates an enlarged bead along one edge of the clamping plates that helps counteract the pullout force the inflatable bladder develops as it is inflated.

Figure 17A:
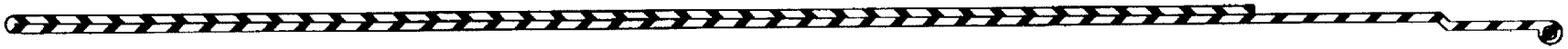
FIG. 17*a* illustrates the cross section of a seamless bladder vulcanized without benefit of a mandrel.
Figure 17B:
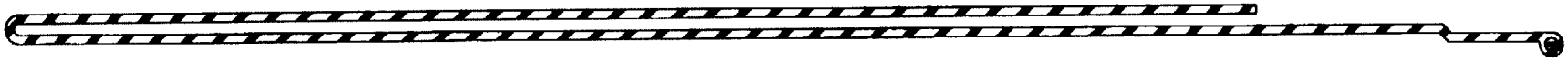
FIG. 17*b* illustrates a not yet folded bladder as vulcanized over a mandrel with rounded edges.

FIG. 17*a* shows how the above air bladder can be constructed without benefit of a mandrel with some thickness. A release compound such as silicone is placed between the two layers that make up the bladder's inner liner. After curing the bladder can be inflated and utilized without the need of removing a mandrel. The advantage of using the mandrel 70 as shown in FIG. 17*b* is that it gives the inflatable air bladder a sufficient inner radius so that the stress concentrations at the bladder interior are kept at a minimum and the rubber elongation is held to a minimum when the bladder is inflated. The advantage of using a release compound instead of a mandrel is the reduction in tooling cost and the possibility of creating a completely sealed bladder in one vulcanization step.

The inside radii created by use of a mandrel with rounded edges and of sufficient thickness are show in FIG. 2*c*. R1 indicates the inside radius to the innerliner 12*d*. R2 indicates the radius to the neutral axis of the innermost reinforcing layer 13*a*. R3 indicates the radius to the neutral axis of the outermost reinforcing layer 13*c*. In order to minimize tensile stresses in the innerliner 12*d*, the ratio $(2\times R1)/(R2+R3)$ should be greater than 0.5. In order to balance the loads in the reinforcing layers the ratio $((R2+R3)/(R3-R2)$ should be greater than 5.

Figure 18:
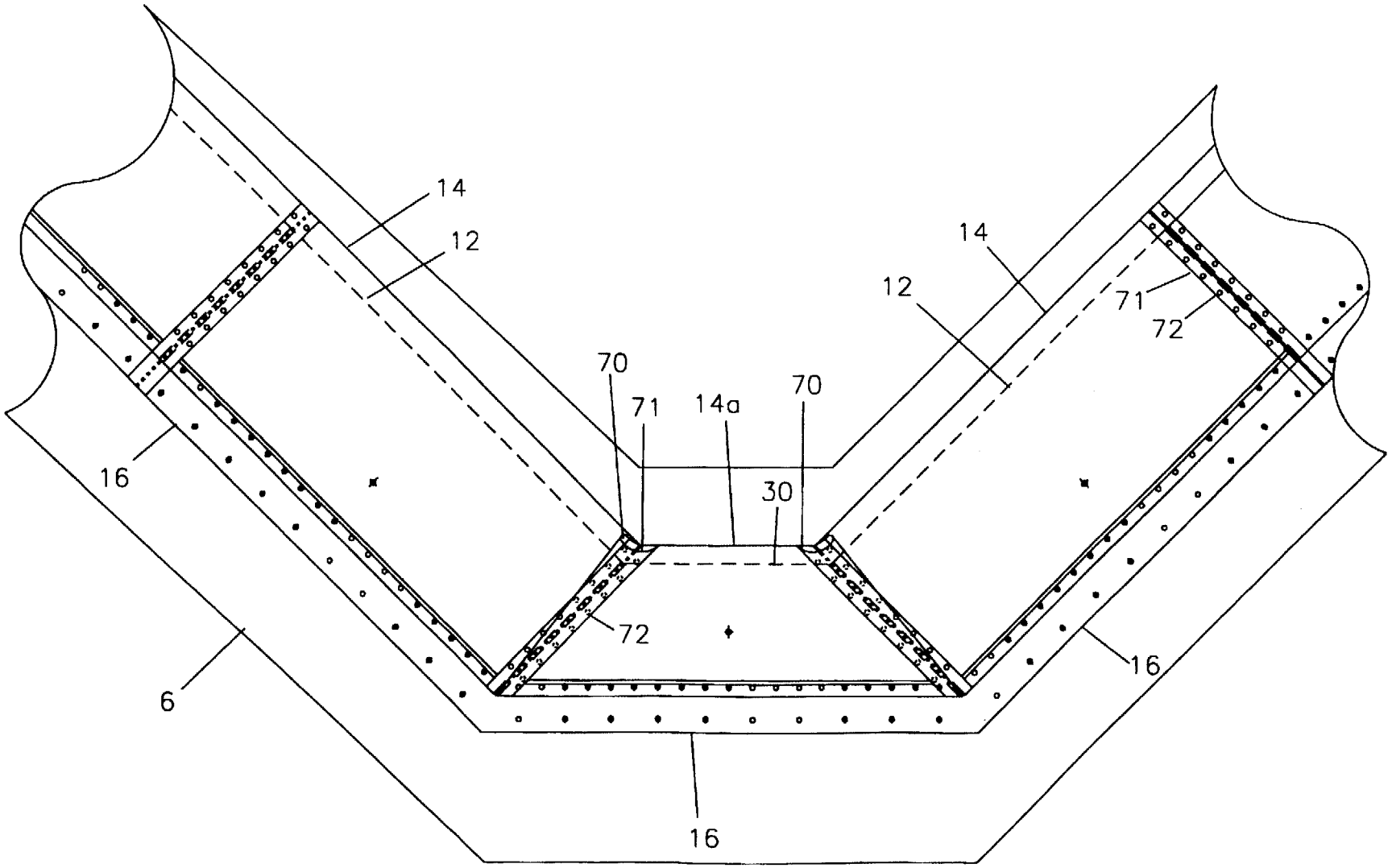
FIG. 18 illustrates the use of one trapezoidal air bladder and two rectangular air bladders to actuate gate panels at the corner of a dam spillway.

Turning to FIG. 18 an angled portion of dam spillway 6 is shown. Using previous technology if crest gates were to be installed on this spillway a pier would have to be installed where the spillway changes direction. By using the above mentioned trapezoidal bladder 30 in conjunction with rectangular bladders 12 or additional trapezoidal bladders and correspondingly similarly shaped gate panels 14*a* and 14 it is possible for the pneumatic crest gate system of this invention to be installed around this angled spillway without the addition of piers. Interpanel webs 70 are shaped to allow changes in distance between the adjacent edges of the gate panels 14. The interpanel webs are attached to the gate panels by means of web retainers 71 and screws 72.

Figure 19:
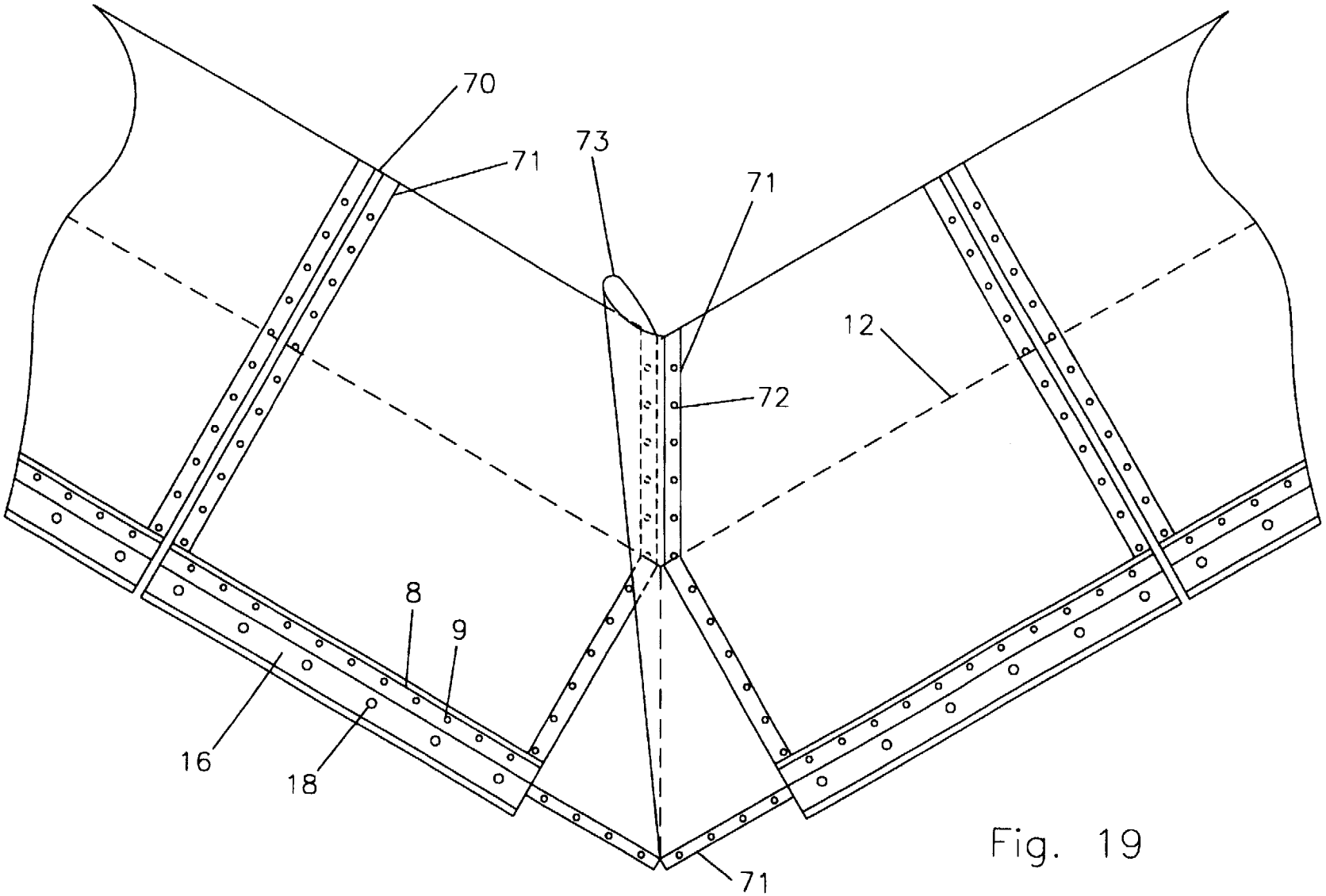
FIG. 19 illustrates the use of a web clamped to the spillway and to two gate panels to prevent leakage between adjacent gate panels mounted to the spillway in differing orientations.
Figure 20A:
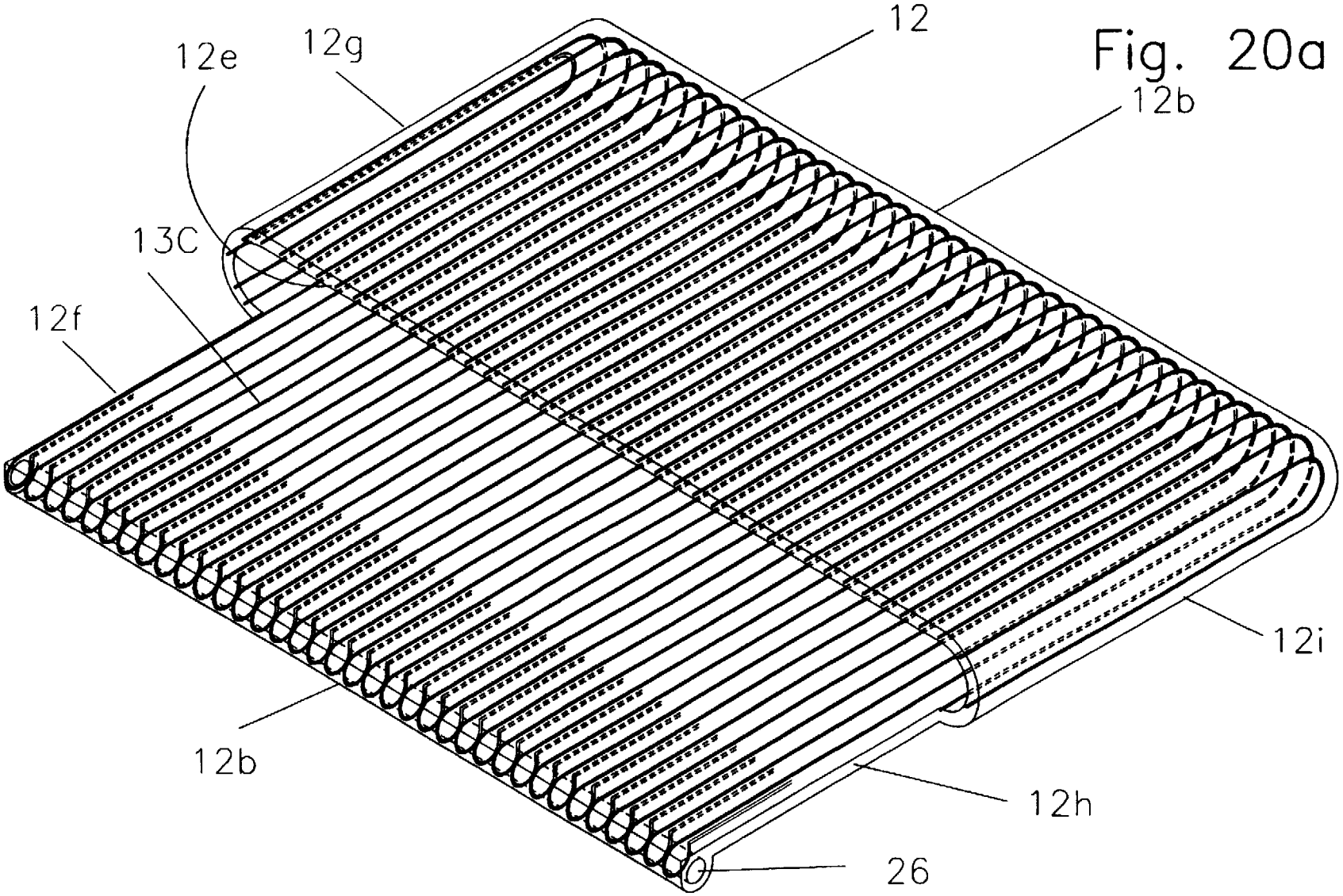
FIG. 20*a* is a view of an air bladder with one edge not yet closed illustrating one of the reinforcing cord layers.
Figure 20B:
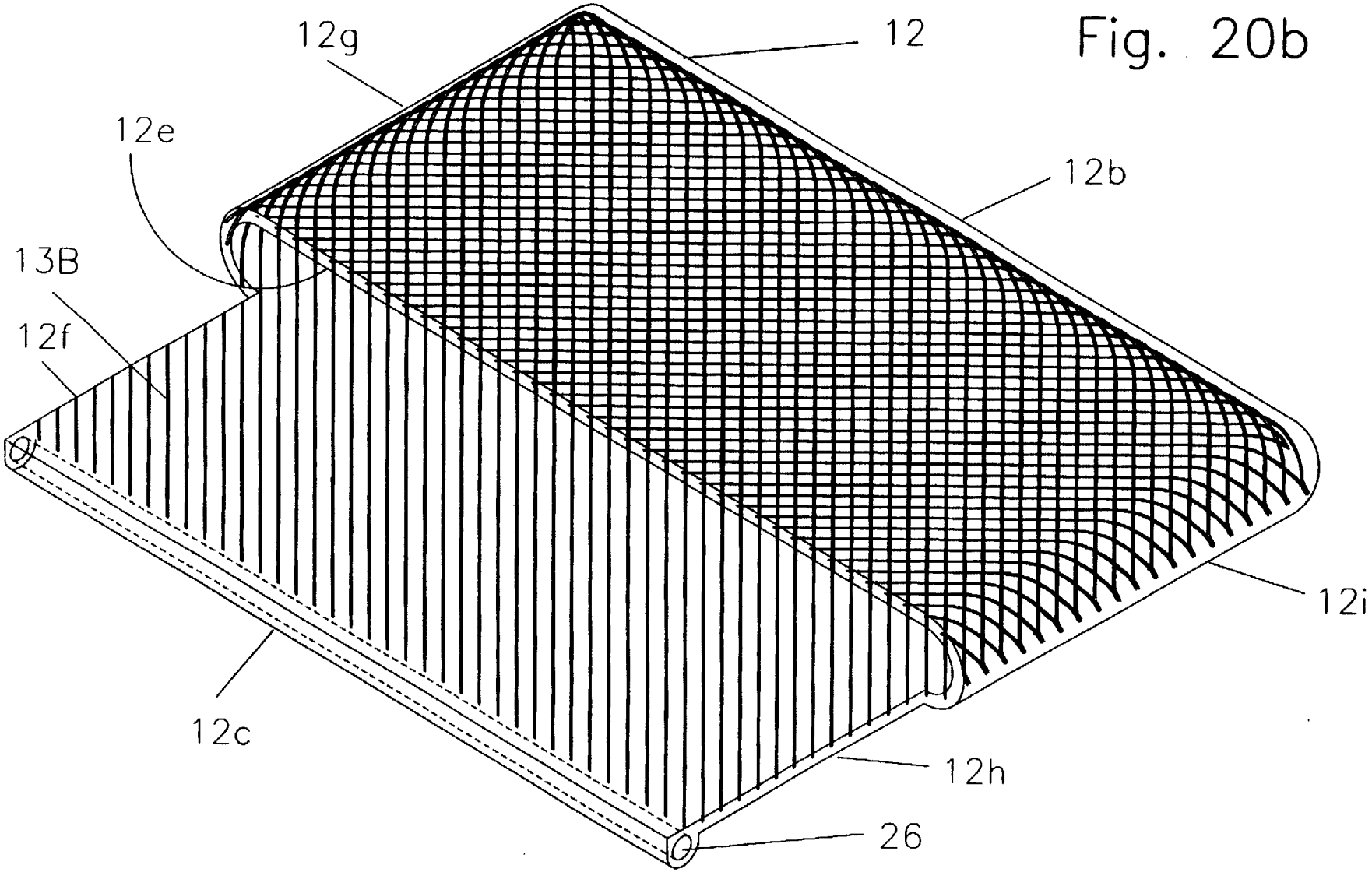
FIG. 20*b* is the same view as in FIG. 20*a* illustrating the orientation of a second reinforcing cord layer.
Figure 20C:
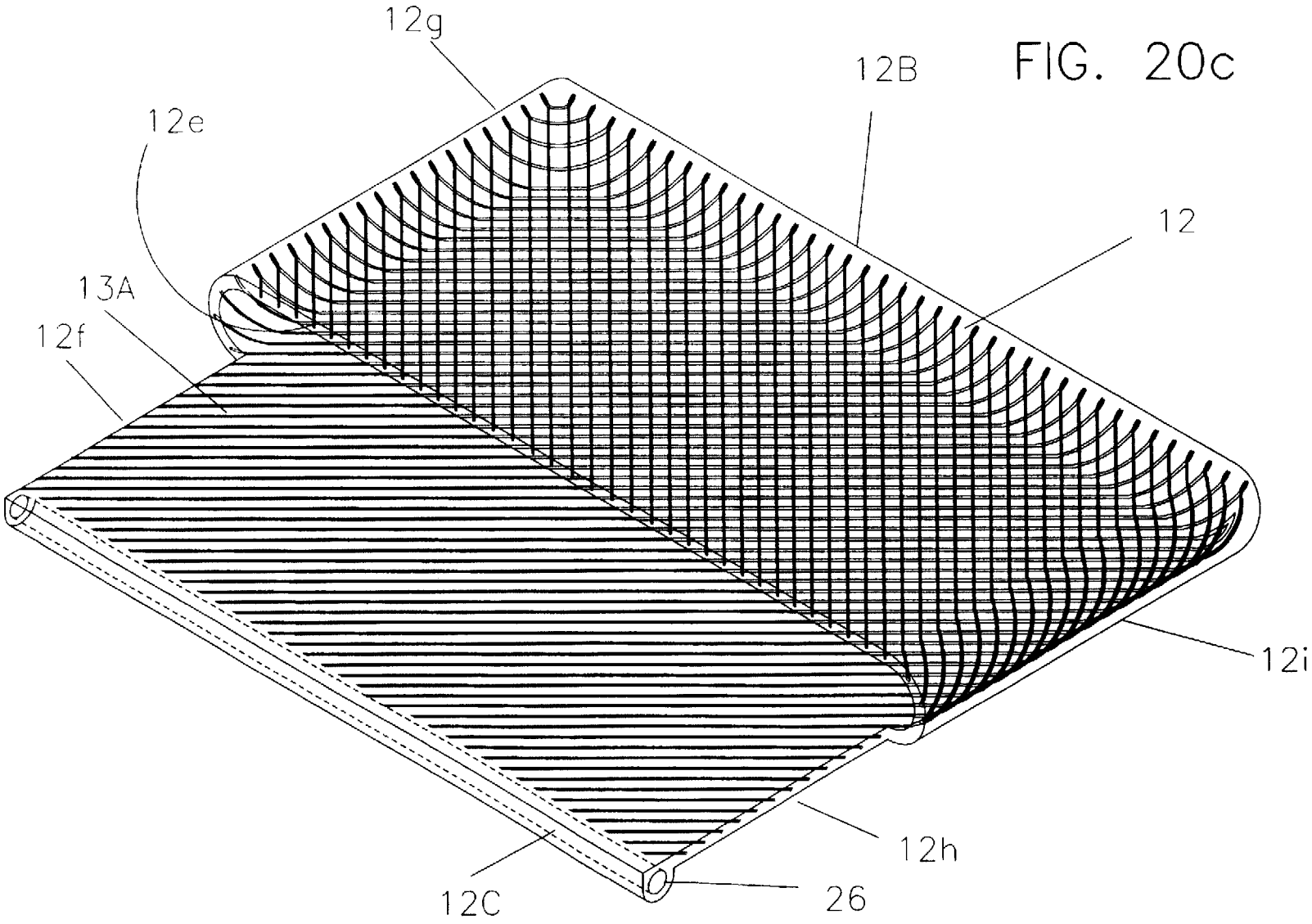
FIG. 20*c* is the same view as in 20*a* and 20*b* illustrating the orientation of a third reinforcing cord layer.

Looking to FIG. 19 an angled portion of a dam spillway 7 is shown. In this application two or more rectangular bladders 12 are placed along each side of an angle in the spillway. Specially shaped gate panels 14*a* are then substituted for the regular rectangular shaped panels. An elastomeric web 69 is then clamped to the spillway and to the two adjacent gate panels to fill the void between said gate panels. By using this type of web a pier is no longer needed at the point where the dam spillway changes direction.

Figure 21:
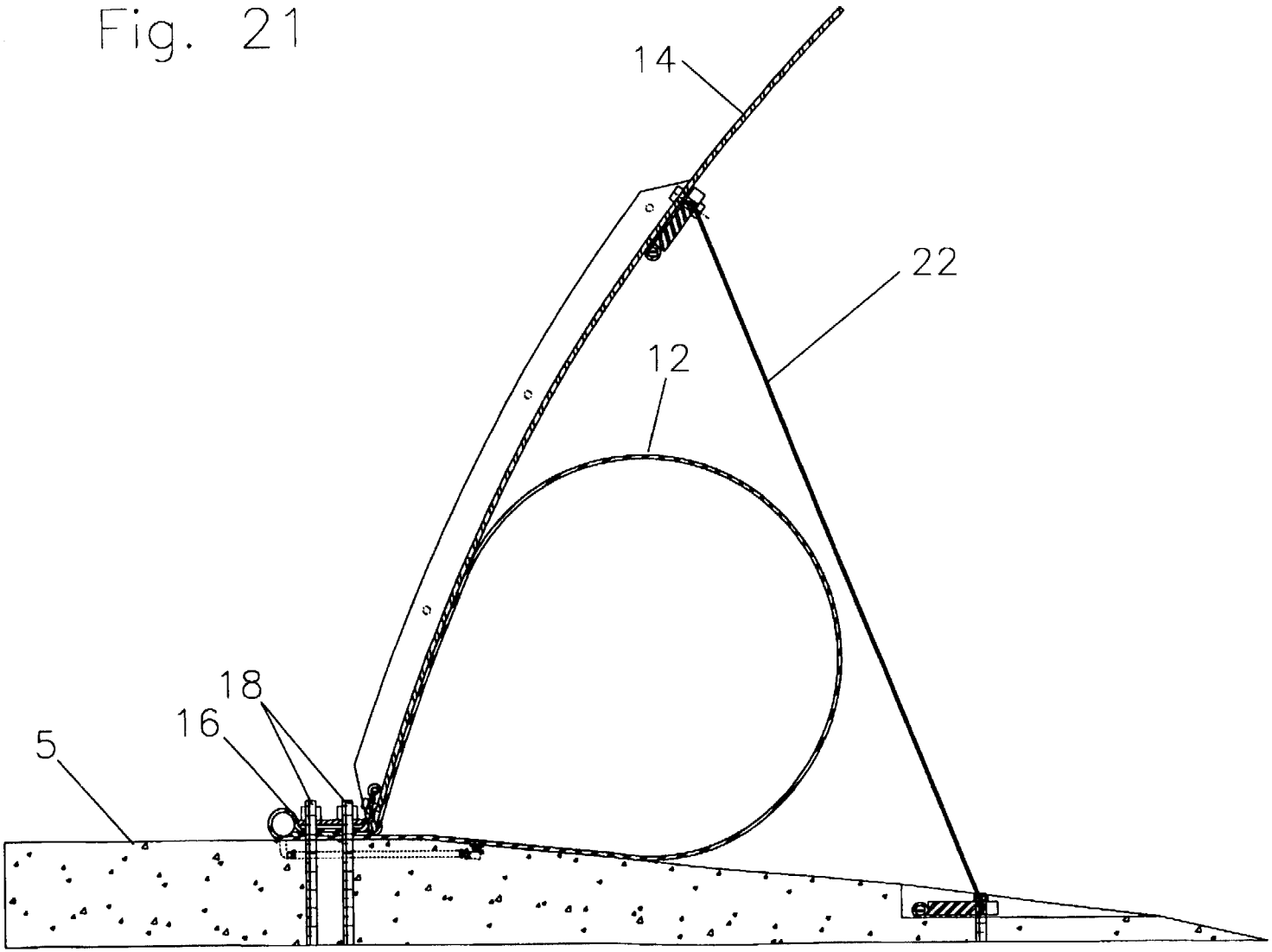
FIG. 21 is a cross section view of a raised gate system incorporating a double row of anchor bolts, a bar on the pivot edge of the gate panel and a gravel occluding elastomeric protrusion on the hinge flap.
Figure 21B:
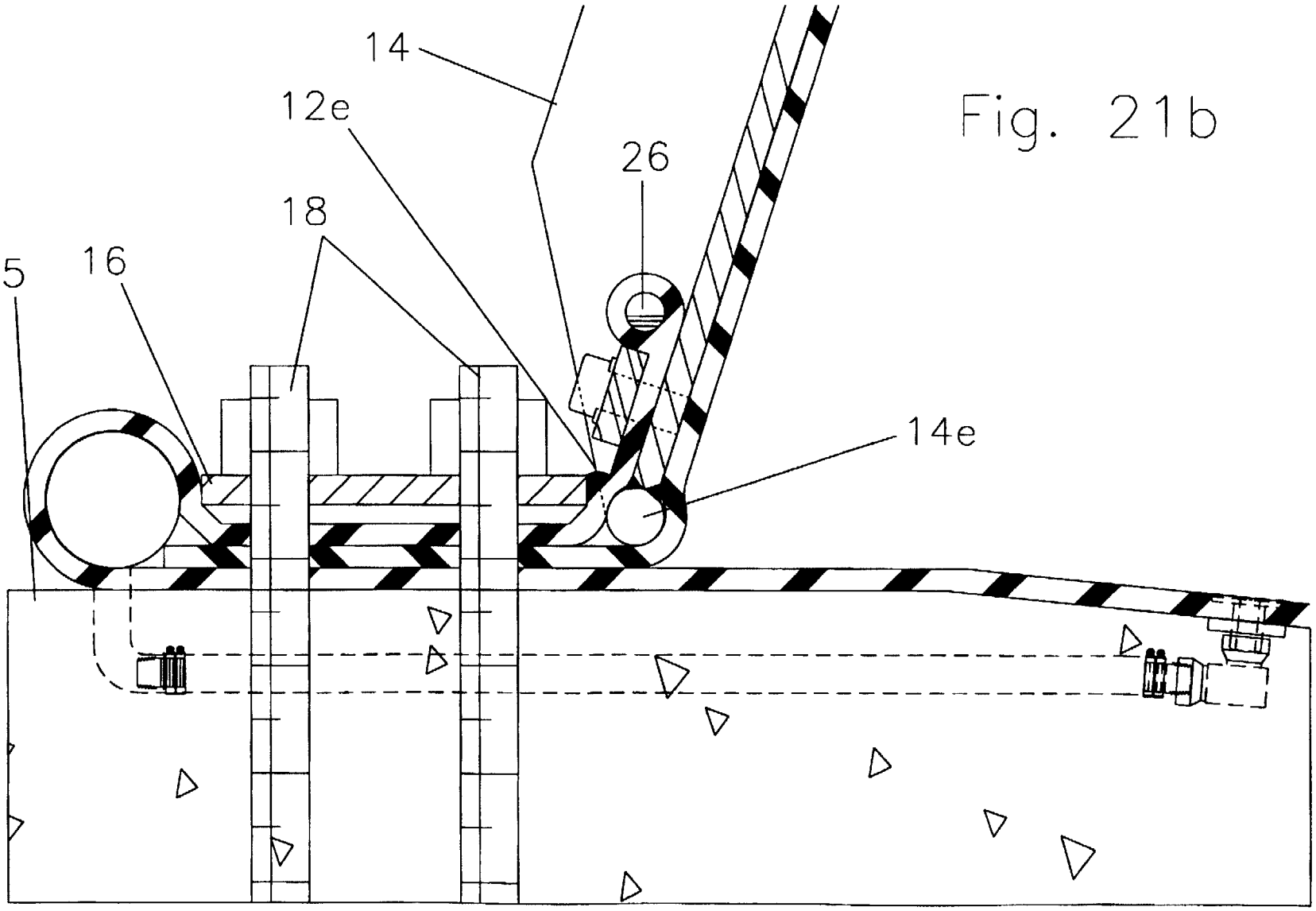
FIG. 21*b* is the same view as in FIG. 21 except enlarged and with the air supply pipe acting also as the upstream bead of the air bladder.
Figure 21C:
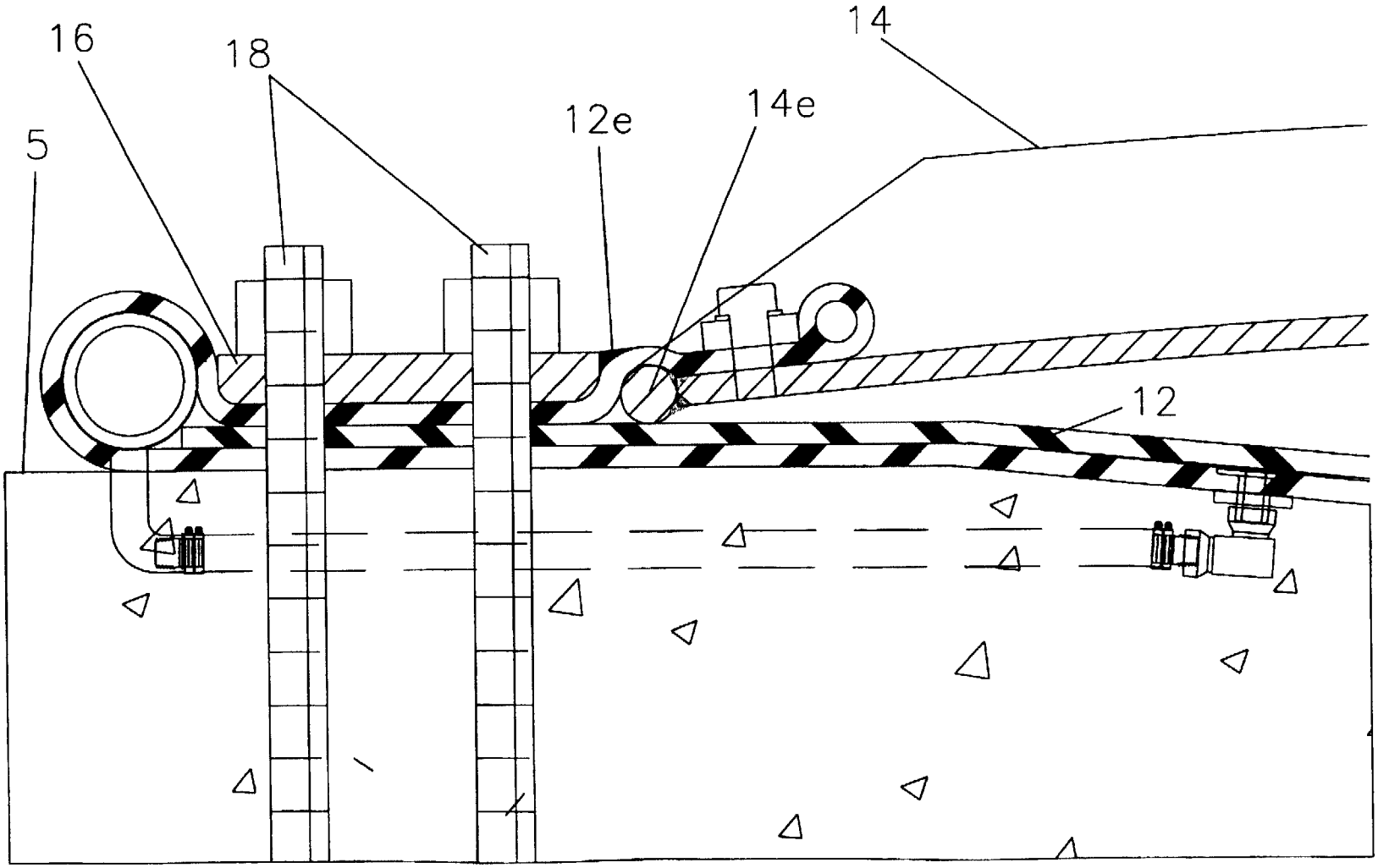
FIG. 21*c* is the same as FIG. 21*b* except with the gate panel lowered.
Figure 21D:
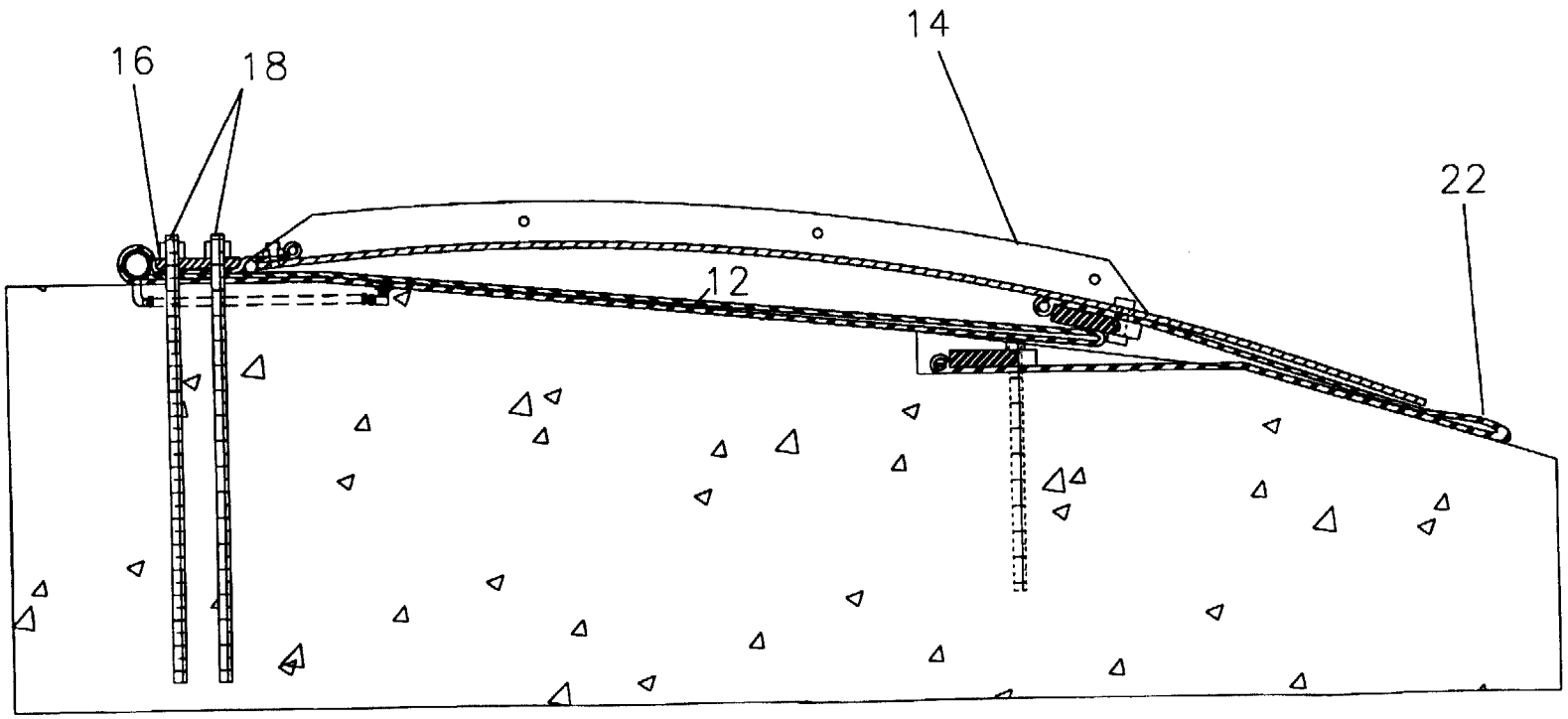
FIG. 21*d* is the same view as FIG. 21*c* except scaled to show the entire cross section.

FIGS. 21*b* and 21*c* illustrate the action of the gravel occluding elastomeric protrusion 12*p* and the bar 14*e* forming the pivot edge of the gate panel. The protrusion 12*p* prevents damage to the hinge flap which might occur during the process of compressing trapped sand and gravel between the hinge flap 12*n* and the clamp bar 16. The bar 14*e* reduces the compressive stresses imparted to the air bladder 12*a* and hinge flap 12*n* by the gate panel 14. The bar 14*e* also contributes stiffness to the gate panel between reinforcing ribs.

What is claimed is:

1. A combination comprising:

(a) an integral vulcanized elastomeric inflatable bladder comprising a plurality of directionally-reinforced elastomeric sheets layered on top of one another so as to create an inflatable envelope including an open edge and a flap portion adjacent said open edge; wherein said flap portion is adapted to be folded over said open edge to close said envelope and form a folded edge portion; wherein said flap portion of said bladder further includes an elongated incompressible insert; and wherein said elastomeric sheets include reinforcing cords having ends which terminate at said open edge;

(b) clamping means disposed along said folded edge portion of the envelope.

2. A combination in accordance with claim 1, wherein said folded edge portion of said bladder comprises a hinge flap.

3. A combination in accordance with claim 1, further comprising a gate panel having a leading edge which is secured to the flap portion of said bladder.

4. A combination in accordance with claim 1, wherein said cords in each sheet are unidirectional.

5. A combination in accordance with claim 1, further comprising an incompressible longitudinal element forming a bead along said flap portion.

6. A combination in accordance with claim 1, wherein said bladder is rectangular in shape.

7. A combination in accordance with claim 1, wherein said bladder is trapezoidal in shape.

8. A combination in accordance with claim 3, wherein said gate panel further comprises reinforcing means for torsionally stiffening said gate panel.

9. A combination in accordance with claim 3, further comprising a spillway having an upper surface to which said inflatable bladder is secured.

10. A combination in accordance with claim 9, further comprising restraining strap means connected between said gate panel and said spillway, wherein said restraining strap comprises an elastomeric material with its reinforcement wrapped around an incompressable insert at each end.

11. A combination in accordance with claim 9, wherein there are a plurality of said bladders spaced along said spillway, and further comprising an elastomeric membrane secured between said bladders and said spillway.

12. A combination in accordance with claim 9, further comprising pickets attached to said gate panel to create a fish barrier.

13. An integral vulcanized elastomeric inflatable bladder comprising a plurality of directionally-reinforced elastomeric sheets layered on top of one another so as to create an inflatable envelope including an open edge and a flap portion adjacent said open edge; wherein said flap portion is adapted to be folded over said open edge to close said envelope and form a folded edge portion.

14. A bladder in accordance with claim 13, having a rectangular shape in which the reinforcing cords are oriented at +45 degrees and −45 degrees to the edges of said bladder.

15. A bladder in accordance with claim 14, wherein one or more additional layers of reinforcing cord are oriented at 90 degrees to the edgealong which all cords terminate.

16. A bladder in accordance with claim 13, further comprising an incompressible longitudinal element forming a bead along said flap portion.

17. A combination in accordance with claim 3, wherein said leading edge of said gate panel comprises an elongated rod member having a circular cross-section of a diameter greater than the thickness of said gate panel.

18. An inflatable bladder in accordance with claim 13, wherein said bladder includes second right and left marginal interior edges, and a downstream interior edge, wherein each said interior edge is rounded when said bladder is in a deflated condition.

* * * * *